US012774842B2

(12) United States Patent
Chung et al.

(10) Patent No.: US 12,774,842 B2
(45) Date of Patent: Oct. 27, 2026

(54) STOREHOUSE

(71) Applicant: LG ELECTRONICS INC., Seoul (KR)

(72) Inventors: Myungjin Chung, Seoul (KR); Yoonseong Nam, Seoul (KR); Jeongwon Park, Seoul (KR); Sounguk Kim, Seoul (KR); Kyungseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 39 days.

(21) Appl. No.: 18/577,338

(22) PCT Filed: Jul. 6, 2022

(86) PCT No.: PCT/KR2022/009790
§ 371 (c)(1),
(2) Date: Jan. 8, 2024

(87) PCT Pub. No.: WO2023/282635
PCT Pub. Date: Jan. 12, 2023

(65) Prior Publication Data

US 2024/0384924 A1 Nov. 21, 2024

(30) Foreign Application Priority Data

Jul. 8, 2021 (KR) ..... 10-2021-0089686

(51) Int. Cl.
*F25D 17/08* (2006.01)
*F25D 17/06* (2006.01)
*F25D 19/02* (2006.01)

(52) U.S. Cl.
CPC ..... *F25D 17/08* (2013.01); *F25D 17/062* (2013.01); *F25D 17/067* (2013.01); *F25D 19/02* (2013.01);
(Continued)

(58) Field of Classification Search
CPC ..... F25D 17/06; F25D 17/062; F25D 17/067; F25D 17/08; F25D 19/02; F25D 2317/06;
(Continued)

(56) References Cited

U.S. PATENT DOCUMENTS 2,767,558 A * 10/1956 Wallenbrock ..... F25D 25/024 62/505
2,792,691 A * 5/1957 Murphy ..... F25D 21/008 62/441
(Continued)

FOREIGN PATENT DOCUMENTS

CN 107588590 1/2018
EP 2505943 A2 * 10/2012 ..... F25D 23/021
(Continued)

OTHER PUBLICATIONS

Translation JP2007085622A, 5 pages (Year: 2007).*
International Search Report dated Oct. 26, 2022 issued in Application No. PCT/KR2022/009790.

*Primary Examiner* — Andrew Roersma
(74) *Attorney, Agent, or Firm* — KED & Associates, LLP

(57) ABSTRACT

The present disclosure relates to a storehouse. In one aspect of the present disclosure, a storehouse may include a first storage space configured to provide a space in which goods are stored within a predetermined temperature or a predetermined temperature range and a second storage space configured to provide a space in which a first heat exchanger is accommodated. The storehouse may include a third storage space configured to provide a space in which a second heat exchanger is accommodated. The storehouse may include a first passage provided inside of a first wall defining a part of the first storage space or in the vicinity of the first wall and through which a fluid flows. The storehouse may include a second passage provided inside of a second wall
(Continued)

defining a part of the second storage space or in the vicinity of the second wall and through which a fluid flows.

16 Claims, 17 Drawing Sheets

(52) U.S. Cl.
CPC ..... *F25D 2317/063* (2013.01); *F25D 2317/0651* (2013.01); *F25D 2317/0661* (2013.01)

(58) Field of Classification Search
CPC ..... F25D 2317/063; F25D 2317/0651; F25D 2317/0661; F25D 2317/067; F25D 2317/068; F25D 2317/0682; F25D 2323/00264
See application file for complete search history.

(56) References Cited

U.S. PATENT DOCUMENTS 2,907,180 A * 10/1959 Mann ..... F25D 21/008 62/227
2,912,834 A * 11/1959 Mann ..... F25D 11/022 62/291
2,959,936 A * 11/1960 Mann ..... F25D 21/14 62/276
3,027,735 A * 4/1962 Preotle ..... F25D 17/062 62/407
3,120,111 A * 2/1964 Simmons ..... F25D 21/008 62/DIG. 13
3,638,449 A * 2/1972 Lichtenberger ..... F25D 17/062 62/272
5,347,827 A * 9/1994 Rudick ..... F25D 17/062 62/255
9,890,984 B2 * 2/2018 Kim ..... F25D 17/062
2002/0134088 A1 * 9/2002 Rudick ..... F28D 15/0266 62/448
2005/0039483 A1 * 2/2005 Yun ..... F25D 17/062 62/448
2005/0172654 A1 * 8/2005 Rohrer ..... F25D 19/02 62/448
2005/0217301 A1 * 10/2005 Iguchi ..... F25D 19/02 62/302
2006/0107677 A1 * 5/2006 Iguchi ..... F25D 23/006 62/302
2006/0207276 A1 * 9/2006 Daddis ..... A47F 3/0408 62/448
2015/0272345 A1 * 10/2015 Bhatia ..... F25D 19/02 62/255
2019/0226749 A1 * 7/2019 Lee ..... F25D 19/00
2020/0386468 A1 * 12/2020 Matsuno ..... F25D 17/06
2021/0025641 A1 * 1/2021 Thomas ..... F25D 19/04
2021/0131717 A1 5/2021 Ko et al.
2022/0128287 A1 * 4/2022 Zhu ..... F25D 17/067
2023/0030291 A1 * 2/2023 Fei ..... F25D 19/02

FOREIGN PATENT DOCUMENTS

JP H063039 A * 1/1994
JP H10-288447 10/1998
JP 2007-085622 4/2007
KR 1020090131138 A * 12/2009
KR 10-2019-0033881 4/2019
KR 1020210053173 A * 5/2021
KR 10-2023-0027367 2/2023

* cited by examiner

STOREHOUSE

CROSS-REFERENCE TO RELATED PATENT APPLICATIONS

This application is a U.S. National Stage Application under 35 U.S.C. § 371 of PCT Application No. PCT/KR2022/009790, filed Jul. 6, 2022, which claims priority to Korean Patent Application No. 10-2021-0089686, filed Jul. 8, 2021, whose entire disclosures are hereby incorporated by reference.

TECHNICAL FIELD

The present disclosure relates to a storehouse.

BACKGROUND ART

A storehouse may include a storage space for storing goods. Examples of the storehouse may include a refrigerator.

The refrigerator is an apparatus that cools objects to be cooled (e.g., food, drugs, and cosmetics) (hereinafter referred to as food for convenience), or stores food at low temperature so as to prevent spoilage and deterioration. The refrigerator includes a storage space in which food is stored, and a refrigeration cycle part that cools the storage space.

The refrigeration cycle part may include a compressor, a condenser, an expansion mechanism, and an evaporator, through which a refrigerant circulates.

A refrigerator according to the related art may include an outer case, and an inner case located inside the outer case and having an opened front side. Such a refrigerator may include a cold air discharge duct disposed inside the inner case to partition the inside of the inner case into a storage space and a heat exchange space. For example, the storage space may be defined in front of the cold air discharge duct, and the heat exchange space may be defined in the rear of the cold air discharge duct. An evaporator and an evaporating fan may be disposed in the heat exchange space.

The refrigerator may have a separate machine space defined outside the inner case. A compressor, a condenser, and a condensing fan may be disposed in the machine space. The compressor in the machine space may be connected to the evaporator in the heat exchange space through a refrigerant pipe.

The storage space may be provided with a withdrawable drawer. A plurality of the drawers may be provided in a vertical direction.

However, the refrigerator according to the related art as described above has the following problems.

First, the compressor in the machine space and the evaporator in the inner case are disposed in spaces separated from each other and are connected to each other by the refrigerant pipe. Therefore, when it is necessary to repair the refrigeration cycle part, it is inconvenient to take out food stored in the refrigerator so as to check and repair failure.

Second, since the evaporator has to be integrally formed inside the refrigerator body and the evaporator has to be fixed to the refrigerator body by welding or the like, there is an inconvenience in manufacturing the refrigerator. In addition, when the evaporator defrosts, heat exchange with the storage space increases the internal temperature of the refrigerator.

Third, since the heat exchange space is disposed in the rear of the storage space, the width of the rear wall of the refrigerator body in the front-and-rear direction increases as much as the size of the heat exchange space. Therefore, the volume of the storage space is reduced as much.

In order to solve these problems, a refrigerator including a cooling module that integrally configures a heat absorbing portion and a heat dissipating portion has been proposed.

DISCLOSURE

Technical Problem

An embodiment of the present disclosure aims to provide a storehouse in which a first storage space configured to provide a space in which goods are stored is fluidly connected to a second storage space configured to provide a space in which a first heat exchanger is accommodated.

An embodiment of the present disclosure aims to provide a storehouse in which a third storage space configured to provide a space in which a second heat exchanger is accommodated is fluidly connected to an outer space of a first storage space.

An embodiment of the present disclosure aims to provide a storehouse in which a first passage through which a fluid flows is provided inside or near a first wall defining at least a part of a first storage space.

An embodiment of the present disclosure aims to provide a storehouse in which a second passage through which a fluid flows is provided inside or near a second wall defining at least a part of a second storage space.

An embodiment of the present disclosure aims to provide a storehouse in which a direction in which a fluid flows in the second passage includes a first portion in which the fluid flows in an X-axis direction and a second portion in which the fluid flows in a Y-axis direction.

Technical Solution

The present disclosure may be a storehouse including a first storage space configured to provide a space in which goods are stored within a predetermined temperature or a predetermined temperature range and a second storage space configured to provide a space in which a first heat exchanger is accommodated.

The storehouse may include a third storage space configured to provide a space in which a second heat exchanger is accommodated.

The storehouse may include a first wall defining at least a part of the first storage space.

The storehouse may include a second wall defining at least a part of the second storage space.

The storehouse may include a third wall defining at least a part of the third storage space.

The storehouse may include a first passage provided inside of the first wall or in the vicinity of the first wall and through which a fluid flows. The storehouse may include a second passage provided inside of the second wall or in the vicinity of the second wall and through which the fluid flows. The second storage space may be fluidly connected to the first storage space.

A fluid in an inner space of the second storage space may pass through the second passage and flow toward the first passage.

The second passage may include a first through hole in contact with the second storage space, a second through hole in contact with the first passage, and a portion connecting the first and second through holes. The first through hole may be configured to provide a path through which a fluid in an inner space of the second storage space flows to an inner space of the second passage.

The second through hole may be configured to provide a path through which the fluid in the inner space of the second passage flows to the first passage.

The first through hole may be spaced apart from the second through hole in an X-axis direction. The first through hole may be provided to be closer to a door than the second through hole.

The second through hole may be provided to be closer to the first passage than the first through hole.

The second through hole may be provided to be aligned with the suction hole of the first passage.

The first through hole may be spaced apart from the second through hole in a Y-axis direction perpendicular to the X-axis direction.

The first through hole may be disposed in a state of being spaced apart from the second through hole in the Y-axis direction. The first through hole may be disposed in a state of being spaced apart from the second through hole in the X-axis direction perpendicular to the Y-axis direction.

A direction in which the fluid flows in the second passage may include a first portion in which the fluid flows in the Y-axis direction and a second portion in which the fluid flows in the X-axis direction.

A direction in which the fluid flows in the second passage may include a portion in which the fluid flows in an inclined direction that is an angle between the Y-axis direction and the X-axis direction.

The second passage may be provided inside or near a wall partitioning the first storage space and the second storage space. After the second passage is disposed inside the second wall, the inside of the second wall may be filled with an insulating material.

The second passage may be disposed to be exposed to the inner space of the first storage space, or may be disposed to be exposed to the inner space of the second storage space.

After the second storage space is coupled to the first storage space, the second passage may be disposed such that the first passage and the second passage are connected through the inner space of the first storage space.

After the second storage space is coupled to the first storage space, the second passage may be disposed such that the first passage and the second passage are connected through the inner space of the second storage space.

An angle between an imaginary line passing through the center of the discharge hole and an imaginary line passing through the center of the suction hole may be greater than 0 degrees and less than 180 degrees.

The imaginary line passing through the center of the discharge hole may be disposed not to meet the imaginary line passing through the center of the suction hole.

In one aspect of the present disclosure, a storehouse may include a first storage space configured to provide a space in which goods are stored within a predetermined temperature or a predetermined temperature range, and a second storage space configured to provide a space in which a first heat exchanger is accommodated.

The storehouse may include a third storage space configured to provide a space in which a second heat exchanger is accommodated.

The storehouse may include a first wall defining at least a part of the first storage space.

The storehouse may include a second wall defining at least a part of the second storage space.

The storehouse may include a third wall defining at least a part of the third storage space.

The storehouse may include a first passage provided inside of the first wall or in the vicinity of the first wall and through which the fluid flows, and a second passage provided inside of the second wall or in the vicinity of the second wall and through which the fluid flows.

The second storage space may be fluidly connected to the first storage space.

A fluid in the inner space of the second storage space may pass through the second passage and flow toward the first passage.

The second passage may include a first through hole in contact with the second storage space, a second through hole in contact with the first passage, and a portion connecting the first and second through holes.

The first through hole may include a discharge hole configured to provide a path through which the fluid in the inner space of the second storage space flows to the inner space of the second passage.

The second through hole may include a suction hole configured to provide a path through which the fluid in the inner space of the second passage flows to the first passage.

The first through hole may be spaced apart from the second through hole in an X-axis direction.

The first through hole may be provided to be closer to a door than the second through hole.

The second through hole may be provided to be closer to the first passage than the first through hole.

The second through hole may be provided to be aligned with the suction hole of the first passage.

The first through hole may be spaced apart from the second through hole in a Y-axis direction perpendicular to the X-axis direction.

A direction in which the fluid flows in the second passage may include a first portion in which the fluid flows in the Y-axis direction and a second portion in which the fluid flows in the X-axis direction.

A direction in which the fluid flows in the second passage may include a portion in which the fluid flows in an inclined direction that is an angle between the Y-axis direction and the X-axis direction.

In another aspect of the present disclosure, a storehouse may include a first wall defining at least a part of the first storage space and a second wall defining at least a part of the second storage space.

The storehouse may include a first passage provided inside of the first wall or in the vicinity of the first wall and through which the fluid flows, and a second passage provided inside of the second wall or in the vicinity of the second wall and through which the fluid flows.

The second storage space may be fluidly connected to the first storage space.

The second passage includes a first through hole in contact with the second storage space, and a second through hole in contact with the first passage.

The first through hole may be provided to be closer to a door than the second through hole.

The second through hole may be provided to be closer to the first passage than the first through hole.

In further another aspect of the present disclosure, a storehouse may include a first storage space configured to provide a space in which goods are stored within a predetermined temperature or a predetermined temperature range and a second storage space configured to provide a space in which a first heat exchanger is accommodated, wherein the second storage space is fluidly connected to the first storage space.

The storehouse may include a second wall defining at least a part of the second storage space, and a second passage provided inside of the second wall or in the vicinity of the second wall and through which the fluid flows.

The second passage may be provided inside or near a wall partitioning the first storage space and the second storage space.

After the second passage is disposed inside the second wall, the inside of the second wall may be filled with an insulating material.

The second passage may be disposed to be exposed to the inner space of the first storage space, or may be disposed to be exposed to the inner space of the second storage space.

After the second storage space is coupled to the first storage space, the second passage may be disposed so that the first passage and the second passage are connected to each other through the inner space of the first storage space, or the second passage may be disposed so that the first passage and the second passage are connected to each other through the inner space of the second storage space.

Advantageous Effects

According to an embodiment of the present disclosure, first and second storage spaces are fluidly connected to each other. Therefore, the fluid heat-exchanged in a first heat exchanger may be easily supplied to the first storage space, and the fluid in the first storage space may be easily returned to the second storage space.

According to an embodiment of the present disclosure, since the fluid in the inner space of the second storage space can pass through a second passage and then flow toward a first passage, the circulation of the fluid may be facilitated.

According to an embodiment of the present disclosure, the second passage may include a first through hole in contact with the second storage space, a second through hole in contact with the first passage, and a portion connecting the first and second through holes, thereby improving the flow of the fluid.

According to an embodiment of the present disclosure, since the direction in which the fluid flows in the second passage is configured to include a portion in which the fluid flows in the Y-axis direction and a portion in which the fluid flows in the X-axis direction, the flowability of the fluid may be improved and the volume ratio of the first storage space may be improved.

MODE FOR INVENTION

Figure 1:
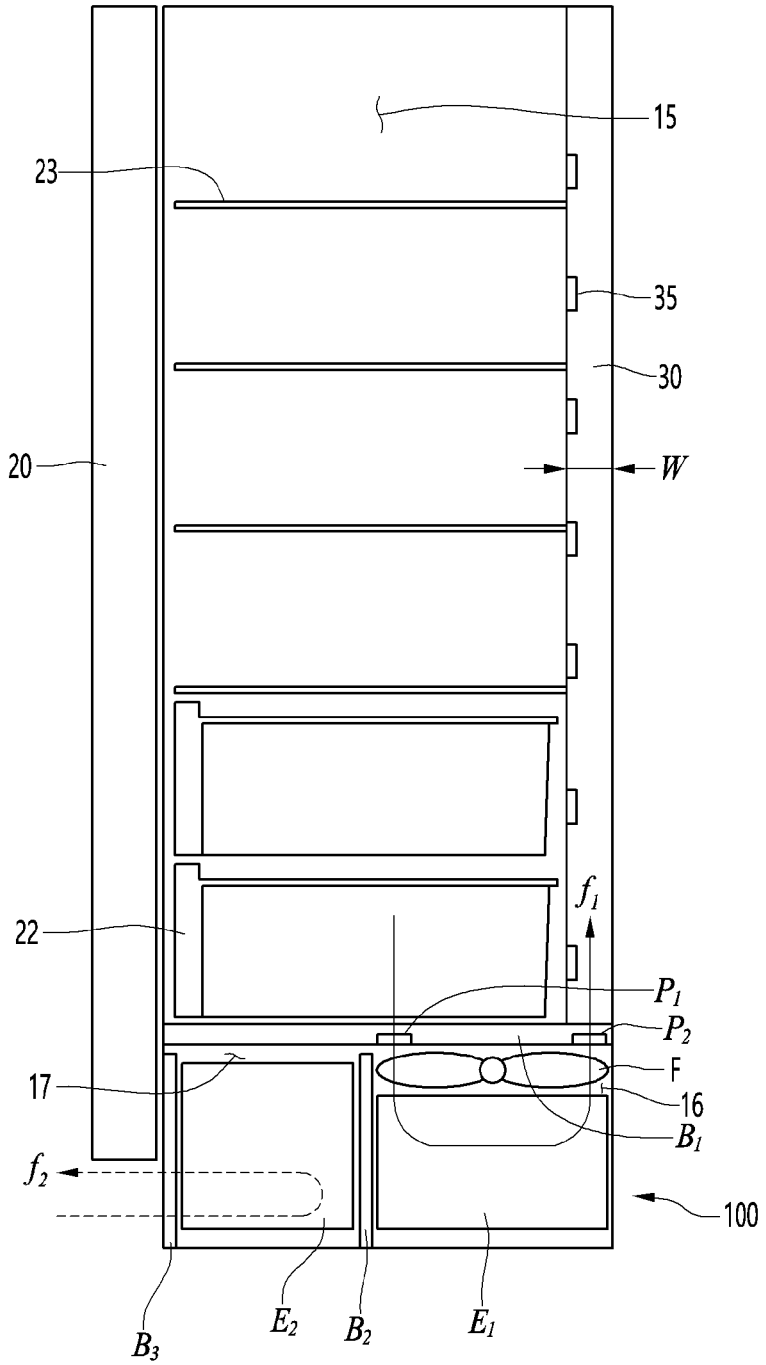
FIG. 1 is a schematic diagram of a storehouse according to an embodiment of the present disclosure.

The present disclosure may be a storehouse including a first storage space configured to provide a space in which goods are stored within a predetermined temperature or a predetermined temperature range and a second storage space configured to provide a space in which a first heat exchanger is accommodated.

Examples of the storehouse may be a refrigerator, a heating cabinet, and the like.

Examples of the goods may include food, medical products, and the like.

The storehouse may include a third storage space configured to provide a space in which a second heat exchanger is accommodated.

The storehouse may include a first wall defining at least a part of the first storage space.

The storehouse may include a second wall defining at least a part of the second storage space.

The storehouse may include a third wall defining at least a part of the third storage space.

The second storage space may be fluidly connected to the first storage space.

The first heat exchanger may be a heat exchanger that is fluidly connected to an inner space of the first storage space to exchange heat with a fluid present in the inner space.

The second heat exchanger may be a heat exchanger that is fluidly connected to an outer space of the first storage space to exchange heat with a fluid present in the outer space.

Examples of a heat exchange method of the heat exchanger may include direct heat exchange by conduction or indirect heat exchange by convection or radiation.

An example of the heat exchanger may be a heat absorbing portion, a cooling power generator, and a heat exchanger provided as a cold source. An example of the cold source may be an evaporator, a heat absorbing surface of a thermoelectric element as a heat absorbing portion of a thermoelectric module, or a cold sink connected to the heat absorbing surface.

Another example of the heat exchanger may be a heat dissipating portion, a heat power generator, and a heat exchanger provided as a heat source. Examples of the heat source may be a condenser, a heat generating surface of a thermoelectric element as a heat dissipating portion of a thermoelectric module, or a heat sink connected to the heat generating surface. Examples of the fluid may include a liquid or a gas, such as air, water, and a refrigerant.

The first wall may be provided to separate the inner space of the first storage space from the outer space of the first storage space.

The second wall may be provided to separate the inner space of the second storage space from the outer space of the second storage space.

The third wall may be provided to separate the inner space of the third storage space from the outer space of the third storage space.

The first wall may be provided to separate the first storage space from at least one of the second storage space and the third storage space.

The second wall may be provided to separate the second storage space from at least one of the first storage space and the third storage space.

The third wall may be provided to separate the third storage space from at least one of the first storage space and the second storage space.

The wall provided to separate the first storage space from the second storage space may be provided as a common wall between the first wall and the second wall.

The wall provided to separate the second storage space from the third storage space may be provided as a common wall between the second wall and the third wall.

The wall provided to separate the first storage space from the third storage space may be provided as a common wall between the first wall and the third wall.

The wall may be provided as one wall including a plurality of layers. A plurality of walls may be connected in a longitudinal direction and provided as one wall.

Fluidly connecting the first space and the second space may be defined as follows: the fluid located in one of the first space and the second space is movable to the other one of the first space and the second space.

The storehouse may include a door provided to open or close the first storage space. The door may be provided to cover at least a part of the second storage space. The door may be provided to cover at least a part of the third storage space.

In the present disclosure, when an object is divided into three equal portions based on the longitudinal direction of the object, the central portion of the object may be defined as the position located in the center among the three equally-divided portions. The peripheral portion of the object may be defined as a portion located to the left or right of the central portion among the three equally-divided portions. The peripheral portion of the object may include a surface in contact with the central portion and a surface opposite thereto. The opposite surface may be defined as a border or an edge of the object.

The storehouse may include a fluid generator disposed on a path through which the fluid flows so that the fluid in the inner space of the storage space flows to the outer space of the storage space.

The fluid generator may include a fluid generator for the second storage space disposed on a path through which the fluid flows so that the fluid in the second storage space flows to the outer space of the second storage space.

The fluid generator may include a fluid generator for the third storage space disposed on a path through which the fluid flows so that the fluid in the third storage space flows to the outer space of the third storage space.

Examples of the fluid generator may include a fan allowing air to flow, a pump allowing water to flow, a compressor allowing a refrigerant to flow, and the like.

A first passage, through which the fluid flows, may be provided inside of the first wall or in the vicinity of the first wall.

Examples of the first passage may be a through hole defined to pass through the inside of the wall, a duct provided inside the wall, or a duct provided outside the wall.

The first passage may include an inlet passage configured to guide the fluid in the outer space of the first storage space to flow to the inner space of the first storage space.

The first passage may include an outlet passage configured to guide the fluid in the inner space of the first storage space to flow to the outer space of the first storage space.

The first passage may include an inlet passage configured to guide the fluid heat-exchanged in the outer space of the first storage space to flow to the inside of the first storage space.

The first passage may include an outlet passage configured to guide the fluid heat-exchanged with goods in the inner space of the first storage space to flow to the outer space of the first storage space.

The inlet passage may be provided in at least one of a front wall, a rear wall, a side wall, an upper wall, and a lower wall of the first storage space.

The outlet passage may be provided in at least one of the front wall, the rear wall, the side wall, the upper wall, and the lower wall of the first storage space.

For example, the inlet passage may be provided as a through hole or a duct disposed in the rear wall of the first storage space.

For example, the outlet passage may be provided as a through hole or a duct disposed in the lower wall of the first storage space.

A second passage, through which the fluid flows, may be provided inside of the second wall or in the vicinity of the second wall.

Examples of the second passage may be a through hole defined to pass through the inside of the wall, a duct provided inside the wall, or a duct provided outside the wall.

The second passage may include an inlet passage configured to guide the fluid in the outer space of the second storage space to flow to the inner space of the second storage space.

The second passage may include an outlet passage configured to guide the fluid in the inner space of the second storage space to flow to the outer space of the second storage space.

The second passage may include an inlet passage configured to guide the fluid heat-exchanged in the outer space of the second storage space to flow to the inside of the second storage space.

The second passage may include an outlet passage configured to guide the fluid heat-exchanged with the first heat exchanger to flow to the outer space of the second storage space.

The inlet passage may be provided in at least one of a front wall, a rear wall, a side wall, an upper wall, and a lower wall of the second storage space.

For example, the inlet passage may be provided as a through hole or a duct disposed in the upper wall of the second storage space.

For example, the outlet passage may be provided as a through hole or a duct disposed in the upper wall of the second storage space.

A third passage, through which the fluid flows, may be provided inside of the third wall or in the vicinity of the third wall.

Examples of the third passage may be a through hole defined to pass through the inside of the wall, a duct provided inside the wall, or a duct provided outside the wall.

The third passage may include an inlet passage configured to guide the fluid in the outer space of the third storage space to flow to the inner space of the third storage space.

The third passage may include an outlet passage configured to guide the fluid in the inner space of the third storage space to flow to the outer space of the third storage space.

The third passage may include an inlet passage configured to guide the fluid heat-exchanged in the outer space of the third storage space to flow to the inside of the third storage space.

The third passage may include an outlet passage configured to guide the fluid heat-exchanged with the second heat exchanger to flow to the outer space of the third storage space.

The inlet passage may be provided in at least one of a front wall, a rear wall, a side wall, an upper wall, and a lower wall of the third storage space.

The outlet passage may be provided in at least one of the front wall, the rear wall, the side wall, the upper wall, and the lower wall of the third storage space.

For example, the inlet passage may be provided as a through hole or a duct disposed in the front wall of the third storage space.

For example, the outlet passage may be provided as a through hole or a duct disposed in the front wall of the third storage space.

The fluid in the inner space of the first storage space may be fluidly connected to one of the second storage space and the third storage space.

For example, the fluid in the inner space of the first storage space may flow to the inner space of the second storage space via the second passage.

The fluid in the inner space of the second storage space may flow to the inner space of the first storage space via the first passage.

The fluid in the outer space of the storehouse may be fluidly connected to one of the second storage space and the third storage space.

For example, the fluid in the inner space of the third storage space may flow to the outer space of the third storage space via the third passage.

The fluid in the outer space of the third storage space may flow to the inner space of the third storage space via the third passage.

The second storage space may be disposed in the outer space of the first storage space together with the third storage space.

At least a part of the second wall may be coupled to at least a part of the third wall and then disposed in the outer space of the first storage space.

At least a part of the second wall may be integrally provided with at least a part of the third wall and then disposed in the outer space of the first storage space.

At least a part of the second wall may extend so as to be provided as at least a part of the third wall.

At least a part of the third wall may extend so as to be provided as at least a part of the second wall.

At least a part of the second wall may extend to support at least a part of the third wall.

At least a part of the third wall may extend to support at least a part of the second wall.

The portion from which the second wall extends may be provided on at least one of the front wall, the rear wall, the side wall, the upper wall, and the rear wall of the second storage space.

The portion from which the third wall extends may be provided on at least one of the front wall, the rear wall, the side wall, the upper wall, and the rear wall of the third storage space.

For example, the portion from which the second wall extends may be provided on the lower wall of the second storage space.

As another example, the portion from which the third wall extends may be provided on the lower wall of the third storage space.

The first heat exchanger acting as a cold source may be provided in the second storage space.

A heat source that removes frost generated in the first heat exchanger may be disposed in the vicinity of the first heat exchanger.

For example, the heat source may be a defrosting heat source.

The first heat exchanger acting as a heat source may be provided in the second storage space.

A cold source that removes steam generated in the first heat exchanger may be disposed in the vicinity of the first heat exchanger.

For example, the cold source may be a steam removing cold source.

The second wall may include a through hole through which the second storage space is fluidly connected to the first storage space.

The second wall may include a portion having a higher degree of insulation than the third wall.

The second wall may be a wall that partitions the first storage space and the second storage space.

In this manner, it is possible to reduce the transfer of the heat of the defrosting heat source or the cold of the steam removing cold source to the first storage space or the outer space of the second storage space.

The second wall may include a through hole through which the second storage space is fluidly connected to the first passage.

The second wall may include a portion having a higher degree of insulation than the wall defining the first passage. In this manner, it is possible to reduce the transfer of the heat of the defrosting heat source or the cold of the steam removing cold source to the first storage space or the outer space of the second storage space.

The first storage space may include a plurality of storage compartments. The first storage space may include at least one of a partition wall, a drawer, and a shelf so as to form the plurality of storage compartments. A passage through which a fluid flows may be provided between the plurality of storage compartments.

An embodiment capable of reducing heat exchange between the defrosting heat source or the steam removing cold source and some of the plurality of storage compartments is as follows. In this manner, when the storehouse is provided as a refrigerator, cooling efficiency may be improved, and when the storehouse is provided as a heating cabinet, heating efficiency may be improved.

First, one of the plurality of storage compartments may include a surface facing the second storage space and a surface facing another one of the plurality of storage compartments.

One of the plurality of storage compartments may be disposed between the second storage space and another one of the plurality of storage compartments. In this case, one of the plurality of storage compartments may be provided as an insulating space for reducing heat transfer between another one of the plurality of storage compartments and the defrosting heat source or the steam removing cold source.

Second, one of the plurality of storage compartments may include both the through hole through which the fluid flows into the second storage space and the through hole through which the fluid flows out from the second storage space, and another one of the plurality of storage compartments may include only one of the through hole through which the fluid flows into the second storage space and the through hole through which the fluid flows out from the second storage space.

For example, the through hole of one of the plurality of storage compartments may be provided inside of the second wall or in the vicinity of the second wall. The through hole of another one of the plurality of storage compartments may be provided inside of the first wall or in the vicinity of the first wall.

Third, only one of the plurality of storage compartments may be disposed to face the second storage space or may be disposed adjacent to the second storage space. For example, one of the plurality of storage compartments may be provided in at least one of the uppermost end, the lowermost end, the rightmost end, the leftmost end, the rearmost end, and the foremost end of the second storage space.

Fourth, the fluid inside the first storage compartment among the plurality of storage compartments may be provided to flow into the second storage space without passing through another one of the plurality of storage compartments, and the fluid inside the second storage compartment among the plurality of storage compartments may be provided to flow into the second storage space through another one of the plurality of storage compartments.

An embodiment in which the second storage space and the third storage space are disposed is as follows.

First, the first storage space may include a portion extending in a horizontal direction, i.e., X-axis direction, and a portion extending in a vertical direction, i.e., Y-axis direction. The second storage space may be disposed adjacent to the third storage space in the X-axis direction. A wall partitioning the second storage space and the third storage space may include a portion extending in the Y-axis direction.

Second, the first storage space may include a portion extending in a horizontal direction, i.e., X-axis direction, and a portion extending in a vertical direction, i.e., Y-axis direction. The second storage space may be disposed adjacent to the third storage space in the Y-axis direction. A wall partitioning the second storage space and the third storage space may include a portion extending in the X-axis direction.

An embodiment in which the first heat exchanger and the fluid generator are disposed is as follows.

First, the first heat exchanger may include a long portion extending in the X-axis direction and a short portion extending in the Y-axis direction, and the fluid generator may be disposed such that a length in the X-axis direction is longer than a length in the Y-axis direction.

The fluid generator may be disposed spaced apart from the first heat exchanger in the Y-axis direction.

For example, the fluid generator may be disposed above or below the first heat exchanger.

The fluid generator may be disposed to overlap the first heat exchanger in the Y-axis direction. The fluid generator may be disposed in an inclined direction with respect to the ground.

A suction hole through which the fluid is sucked into the first heat exchanger may be disposed to be lower than a discharge hole through which the fluid heat-exchanged with the first heat exchanger is discharged.

In this manner, the effect of reducing the flow loss of the fluid generator may be obtained.

Second, the first heat exchanger may include a long portion extending in the X-axis direction and a short portion extending in the Y-axis direction, and the fluid generator may be disposed such that a length in the X-axis direction is shorter than a length in the Y-axis direction.

The fluid generator may be disposed spaced apart from the first heat exchanger in the X-axis direction. For example, the fluid generator may be disposed in the front or rear of the first heat exchanger. The fluid generator may be disposed to overlap the first heat exchanger in the X-axis direction.

The storehouse may include a fluid generator for the second storage space. An embodiment of the arrangement of the fluid generator is as follows.

First, an imaginary line extending from the center of the fluid generator toward the first heat exchanger may be disposed to pass through the first heat exchanger. The center of the fluid generator may be defined as at least one of the center of gravity, the center of mass, the center of volume, and the center of rotation of the fluid generator. The imaginary line may be disposed to pass through the central portion of the first heat exchanger. The imaginary line may be disposed to pass through the peripheral portion of the first heat exchanger.

Second, an imaginary line extending from the center of the fluid generator toward the first storage space may be disposed to pass through the first storage space. An imaginary line extending from the center of the fluid generator toward the first heat exchanger may be disposed so as not to overlap the first heat exchanger.

Third, the fluid generator may be disposed inside the second storage space. In this case, the first heat exchanger and the fluid generator may be disposed inside the second storage space, which may be advantageous in designing a module for the second storage space. At least a part of the second passage may be provided to be exposed to the second storage space.

Fourth, the fluid generator may be disposed in at least one of the inside of the first passage and the inside of the second passage. In this case, since the distance between the first heat exchanger and the fluid generator may be separated, there is an advantage that can reduce a dead zone that may occur in the flow passage of the fluid. The passage on which the fluid generator is disposed may include a portion protruding toward the first storage space. Therefore, the volume of the first storage space may be increased. The fluid generator may be disposed inside the protruding portion.

Fifth, at least a part of the fluid generator may be provided to form at least a part of the first passage or at least a part of the second passage. For example, the fluid generator may include a fan and a fan housing. The fan housing may define at least a part of the first passage, or the fan housing may define at least a part of the second passage.

Hereinafter, some embodiments of the present disclosure will be described in detail with reference to exemplary drawings. In assigning reference numerals to the components of the drawings, it should be noted that the same components are denoted by the same reference numerals as much as possible even though the components are shown in different drawings. In addition, in describing the embodiments of the present disclosure, if the detailed description of the relevant known functions or configurations is determined to unnecessarily obscure the gist of the present disclosure, the detailed description thereof is omitted.

In addition, the terms, such as "first", "second", "A", "B", "(a)", or "(b)" may be used herein to describe the components of the present disclosure. These terms are only for distinguishing one component from another, and the essence, order, or sequence of the components is not limited by the terms. When one component is described as being "connected", "coupled", or "linked" to another component, the component may be directly connected or coupled to the other component, but it should be understood that another component may be "connected", "coupled" or "linked" between components.

FIG. 1 is a schematic diagram of a storehouse according to an embodiment of the present disclosure.

Referring to FIG. 1, a storehouse 1 according to an embodiment of the present disclosure includes a storehouse body 10 defining a first storage space 15.

The storehouse may be configured as a refrigerator or a heating cabinet.

The first storage space 15 may provide a space in which goods are stored within a predetermined temperature or a predetermined temperature range.

The storehouse 1 may include a first wall defining at least a part of the first storage space 15.

The first wall may include at least one of a front wall, a rear wall, a side wall, an upper wall, and a lower wall.

The first wall may include a plurality of walls.

For example, the storehouse body 10 may have a hexahedral shape with an opened front side. However, the shape of the storehouse body 10 is not limited thereto.

The storehouse body 10 may include a body outer case 11 (referring to FIG. 2), a body inner case 12 (referring to FIG. 2) assembled inside the body outer case 11, and a body insulating material 13 (referring to FIG. 2) for insulation provided between the body outer case 11 and the body inner case 12.

The storehouse 1 may further include a door 20 capable of opening or closing the first storage space 15. The door 20 may be movably provided in front of the storehouse body 10.

A shelf 23 on which food is supported may be provided in the first storage space 15. For example, a plurality of shelves 23 may be vertically spaced apart from each other in the first storage space 15.

A drawer 22 that accommodates food may be provided in the first storage space 15. The drawer 22 is provided to be withdrawable. The drawer 22 may be provided in plurality. For example, the plurality of drawers 22 may be vertically spaced apart from each other in the first storage space 15.

A plurality of storage compartments may be defined by the plurality of shelves 23 or the plurality of drawers 22.

A duct 30 for supplying a fluid to the first storage space 15 may be provided on the rear wall of the first storage space 15.

The duct 30 may constitute a first passage through which the fluid flows in the inside of the first wall or in the vicinity of the first wall defining the first storage space 15.

The duct 30 may be located behind the plurality of drawers 22.

The fluid heat-exchanged in a second storage space 16 flows through the duct 30, and a duct discharge hole 35 through which the fluid is discharged to the first storage space 15 may be defined on the front surface of the duct 30.

A plurality of duct discharge holes 35 may be defined. The plurality of duct discharge holes 35 may be disposed vertically.

The duct 30 extends in the vertical direction and is configured to have a constant width w in the front-and-rear direction. Due to the duct 30 having a constant width, the plurality of drawers 22 may be disposed vertically with the same size and shape.

The storehouse 1 may include the second storage space 16 providing a space in which a first heat exchanger E1 is accommodated.

The second storage space 16 may be partitioned from the first storage space 15 by a partition wall B1.

The partition wall B1 may constitute at least a part of the first storage space 15.

The partition wall B1 may constitute at least a part of the second storage space 16.

The partition wall B1 may constitute at least a part of the third storage space 17.

The storehouse 1 may include a third storage space 17 providing a space in which a second heat exchanger E2 is accommodated.

The first heat exchanger E1 and the second heat exchanger E2 may be separated by an insulating wall B2.

The insulating wall B2 may constitute at least a part of the second storage space 16.

The insulating wall B2 may constitute at least a part of the third storage space 17.

The storehouse 1 may include a heat exchange device 100. The heat exchange device 100 includes the first heat exchanger E1 and the second heat exchanger E2.

For example, the heat exchange device 100 may be detachably disposed at the lower portion of the storehouse body 10. However, the present disclosure is not limited thereto, and the first heat exchanger E1 and the second heat exchanger E2 may be provided separately from each other.

The second heat exchanger E2 may be disposed in the front portion of the heat exchange device 100, and the first heat exchanger E1 may be disposed in the rear portion of the heat exchange device 100.

The insulating wall B2 may be located between the first heat exchanger E1 and the second heat exchanger E2.

Two independent flows may be generated in the heat exchange device 100. The two independent flows may include a first flow f1 circulating through the first and second storage spaces 15 and 16 and a second flow f2 passing through the inside and the outside of the third storage space 17.

The heat exchange device 100 may further include a cover B3 through which the second flow f2 passes.

The cover B3 may define at least a part of the third storage space 17.

The cover B3 may include a cover inlet portion through which the fluid outside the third storage space 17 is guided to flow into the third storage space 17, and a cover discharge portion through which air heat-exchanged in the third storage space 17 is discharged.

For example, outside air may be introduced from the front side to the third storage space 17 through the cover inlet portion, and may be discharged from the third storage space 17 to the front side through the cover discharge portion.

However, the direction in which the outside air is introduced and discharged is not limited thereto.

The second flow f2 may be generated by a fluid generator, for example, a second fan, and may circulate through the cover inlet portion of the cover B3, the third storage space 17, and the cover discharge portion of the cover B3.

At least a part of the cover B3 may be shielded by the door 20. For example, the lower end portion of the door 20 may be formed at a position lower than the upper end portion of the cover B3.

As another example, the cover B3 may be located under the door 20. The upper end portion of the cover B3 may be formed at a position corresponding to the lower end portion of the door 20 or a position lower than the lower end portion of the door 20.

However, the relative positions of the cover B3 and the door 20 may not be limited thereto.

An inlet portion P1 through which the fluid in the first storage space 15 is introduced into the second storage space 16 and an outlet portion P2 through which the fluid heat-exchanged in the second storage space 16 is discharged to the duct 30 may be formed in the partition wall B1.

For example, the inlet portion P1 may be disposed above the front portion of the second storage space 16, and the outlet portion P2 may be disposed above the rear portion of the second storage space 16.

The first flow f1 may circulate through the inlet portion P1, the second storage space 16, and the outlet portion P2.

For example, the first heat exchanger E1 may include an evaporator.

For example, the second heat exchanger E2 may include a condenser.

The storehouse 1 may include a fluid generator disposed downstream of the first heat exchanger E1 to generate a flow. For example, the fluid generator may include a first fan F.

The first fan F may be disposed inside the second storage space 16, inside the partition wall B1, or inside the first storage space 15.

For example, the first fan F may be disposed above the first heat exchanger E1. However, the location of the first fan F is not limited thereto, and the first fan F may be provided at another location if the first fan F is disposed on the outlet side of the first heat exchanger E1.

The first fan F may be fluidly connected to the inlet portion P1 and the outlet portion P2. For example, based on the passage of the fluid, the first fan F may be provided between the inlet portion P1 and the outlet portion P2.

The fluid, which is introduced into the second storage space 16 through the inlet portion P1, may pass through the first heat exchanger E1 and the first fan F and then circulate to the duct 30 through the outlet portion P2.

Figure 2:
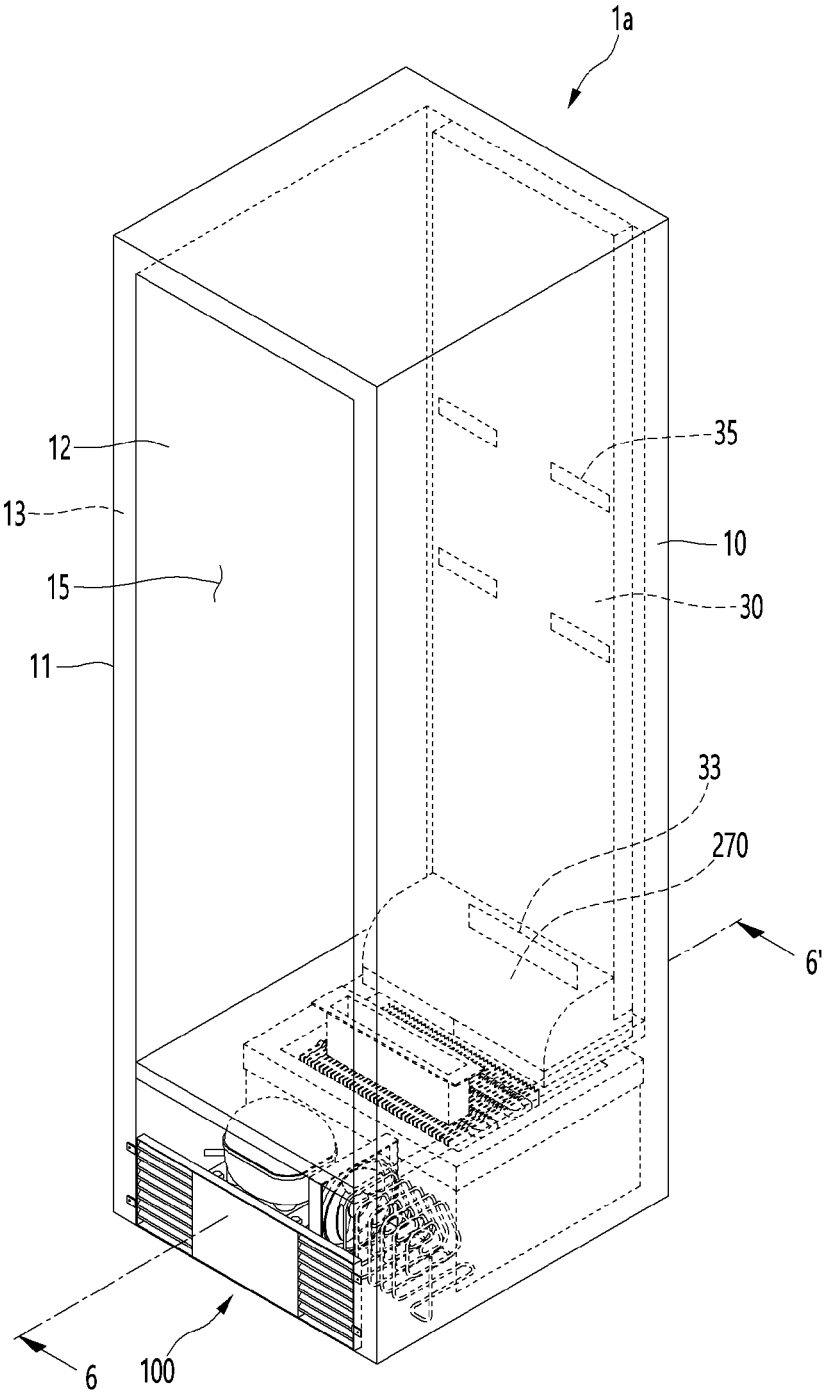
FIG. 2 is a front perspective view of a storehouse body according to a first embodiment of the present disclosure.
Figure 3:
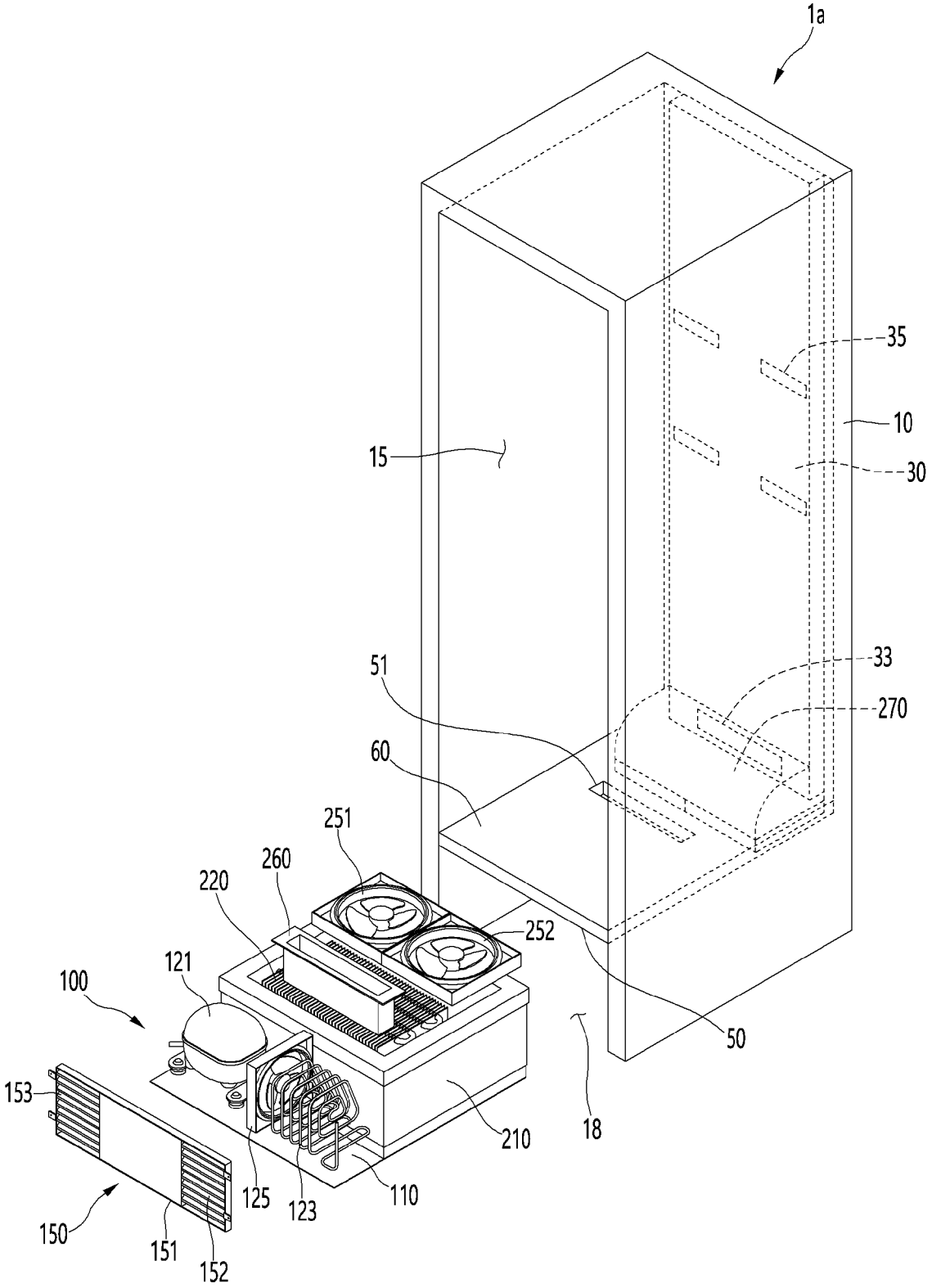
FIG. 3 is an exploded perspective view of a storehouse body and a heat exchange device according to the first embodiment of the present disclosure.
Figure 4:
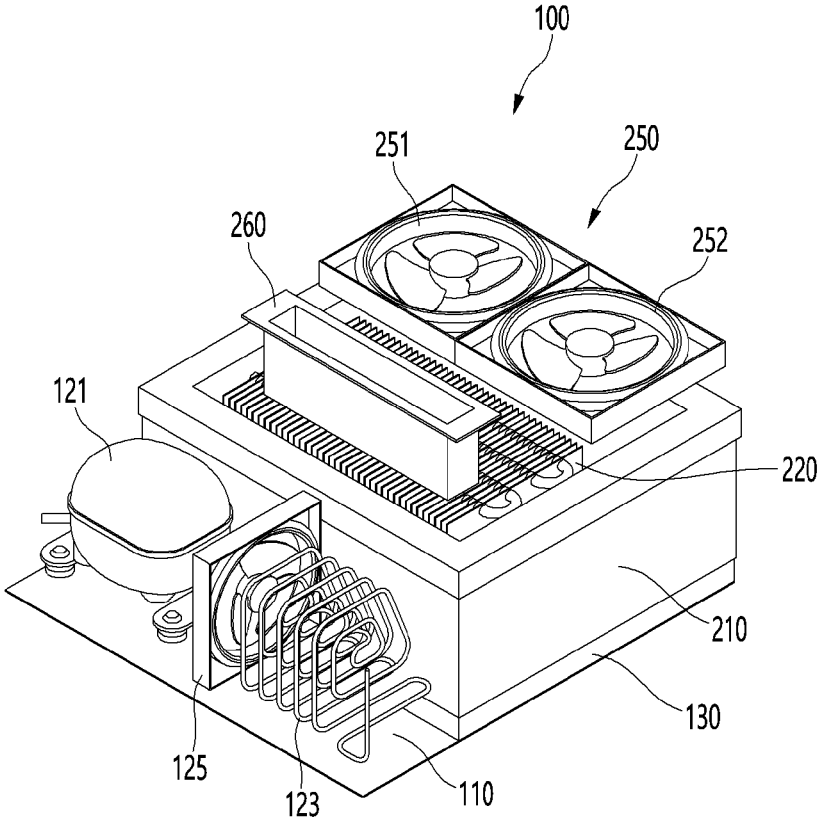
FIG. 4 is a perspective view of a heat exchange device according to the first embodiment of the present disclosure.
Figure 5:
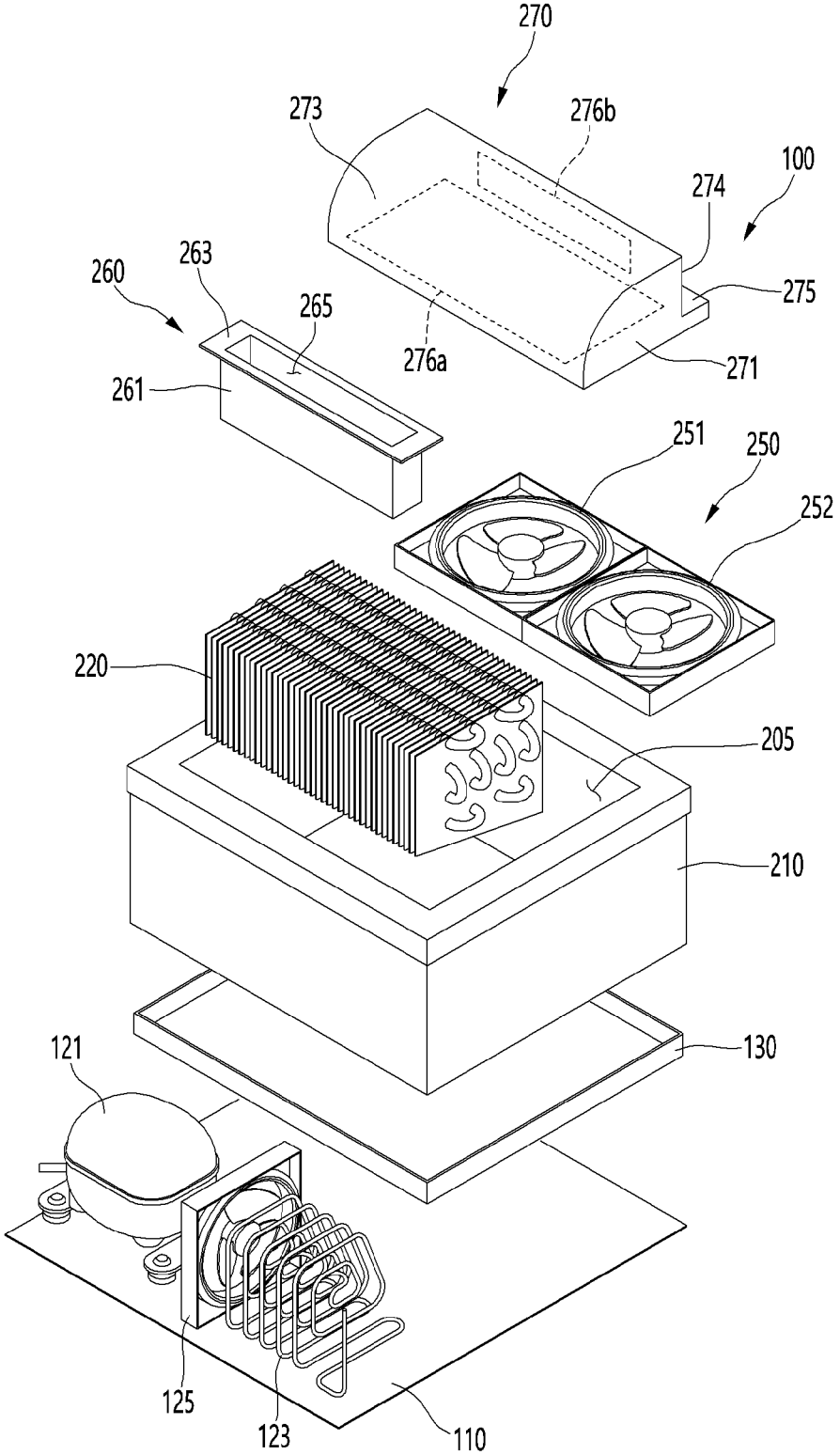
FIG. 5 is an exploded perspective view of a heat exchange device according to the first embodiment of the present disclosure.
Figure 6:
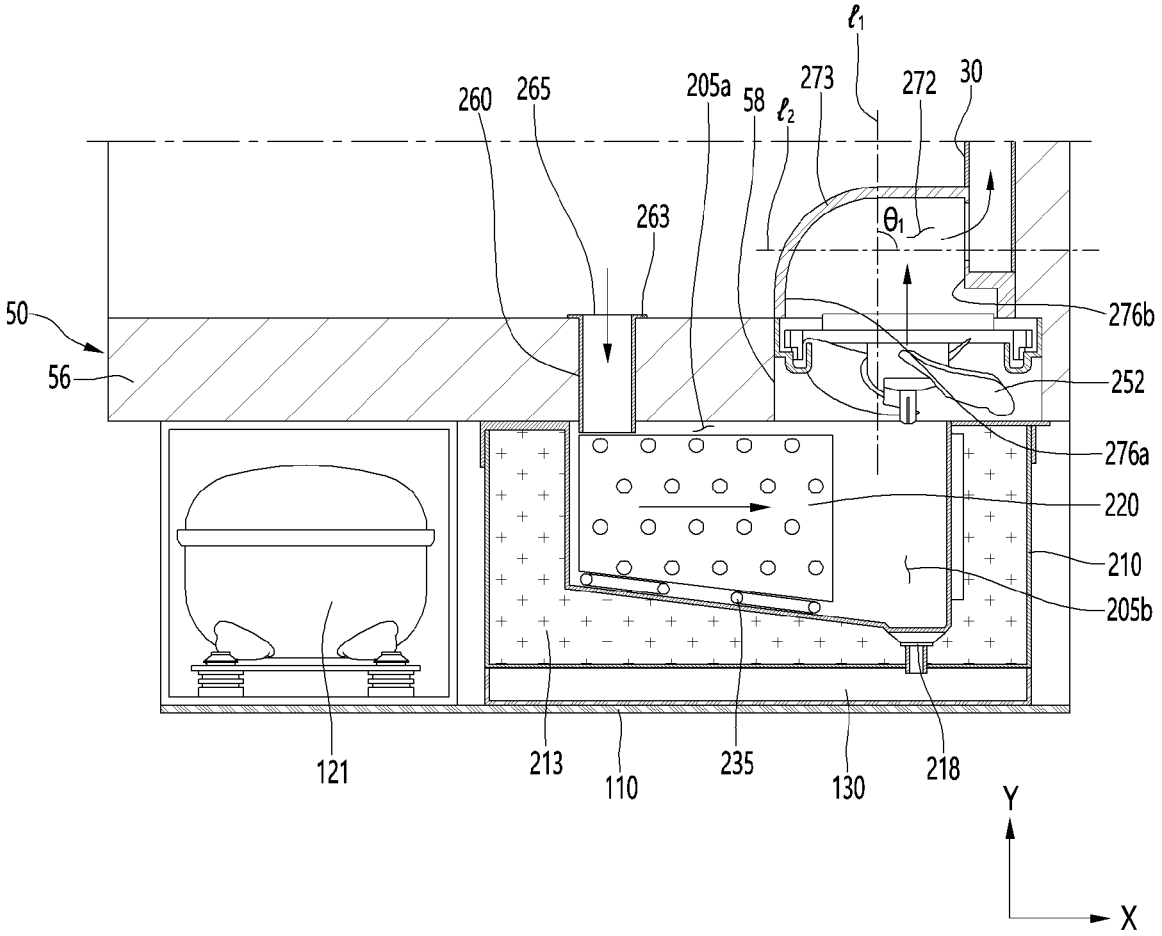
FIG. 6 is a cross-sectional view taken along line 6-6' of FIG. 2.

FIG. 2 is a front perspective view of the storehouse body according to a first embodiment of the present disclosure, FIG. 3 is an exploded perspective view of the storehouse body and the heat exchange device according to the first embodiment of the present disclosure, FIG. 4 is a perspective view of the heat exchange device according to the first embodiment of the present disclosure, FIG. 5 is an exploded perspective view of the heat exchange device according to the first embodiment of the present disclosure, and FIG. 6 is a cross-sectional view taken along line 6-6' of FIG. 2.

Referring to FIGS. 2 to 6, the storehouse 1 according to the present disclosure may include the storehouse body 10 defining the first storage space 15.

The storehouse 1 may further include a heat exchange device 100 including a refrigeration cycle part.

The refrigeration cycle part may include a first heat exchanger 220 installed in a second storage space 16 as a first heat exchange portion, and first fans 251 and 252 as a fluid generator. The fluid in the first storage space 15 may circulate through a space in which the first heat exchange portion is installed.

For example, the first heat exchanger 220 may include an evaporator, and the first fans 251 and 252 may include a cooling fan. In this case, the first heat exchange portion may constitute a cooling portion for generating cold air.

The first fans 251 and 252 may be provided with two fans, and the two fans may be arranged side by side in the width direction of the first heat exchanger 220. Due to the provision of the two fans, the amount of cold air circulating through the first and second storage spaces 15 and 16 may be increased.

The refrigeration cycle part may include a compressor 121 and a second heat exchanger 123 as a second heat exchange portion, and a second fan 125 as a fluid generator. The fluid outside the third storage space 17 may circulate through a space in which the second heat exchange portion is installed.

For example, the second heat exchanger 123 may include a condenser, and the second fan 125 may include a condensing fan. In this case, the second heat exchange portion may constitute a heat dissipation portion that dissipates heat.

The heat exchange device 100 may be installed in a device accommodation space 18. The device accommodation space 18 may include a second storage space 16 in which the first heat exchanger 220 is installed, and a third storage space 17 in which the second heat exchanger 123 is installed.

The first storage space 15 and the device accommodation space 18 may be separated by a partition wall 50.

The partition wall 50 may be located between the storage space 15 and the device accommodation space 18.

For example, the partition wall 50 may vertically separate the first storage space 15 and the device accommodation space 18.

For example, the partition wall 50 may constitute a part of a body inner case 12.

The partition wall 50 may include a wall insulating material 56 (see FIG. 6) for insulating the first storage space 15 and the device accommodation space 18.

The device accommodation space 18 may be located below the first storage space 15.

The device accommodation space 18 may have a smaller volume than the first storage space 15.

The heat exchange device 100 may be located at the lower end portion of the storehouse body 10.

An inlet portion 51 through which the fluid in the first storage space 15 is introduced into the second storage space 16 of the heat exchange device 100 is defined in the partition wall 50. The inlet portion 51 may pass through the partition wall 50 to communicate with the second storage space 16 of the heat exchange device 100.

The inlet portion 51 may include a hole defined to be long in the left-and-right direction.

A suction connector 260 may be provided in the inlet portion 51. For example, the suction connector 260 may be inserted into the inlet portion 51. The suction connector 260 may extend from the upper side of the first heat exchanger 220 toward the first storage space 15.

The storehouse 1 may further include a cover 150 that is provided in front of the heat exchange device 100 and introduces the fluid from the outside of the third storage space 17.

The cover 150 may include a cover body 151 having a size corresponding to the front surface of the heat exchange device 100, a cover inlet portion 152 through which the fluid is introduced into the third storage space 17, and a cover outlet portion 153 through which the fluid passing through the third storage space 17 of the heat exchange device 100 is discharged.

The cover inlet portion 152 and the cover outlet portion 153 may be disposed on both sides of the cover body 151.

The cover inlet portion 152 may be located in front of the second heat exchanger 123. The cover outlet portion 153 may be located in front of the compressor 121.

The fluid, which is introduced into the third storage space 17 of the heat exchange device 100 through the cover inlet portion 152, may be heat-exchanged through the second heat exchanger 123 and the compressor 121 and may be discharged to the outside of the storehouse through the cover outlet portion 153.

The second heat exchange portion of the heat exchange device 100 may be disposed in the front region of the heat exchange device 100. The second heat exchange portion may include a compressor 121, a second fan 125, and a second heat exchanger 123.

The compressor 121, the second fan 125, and the second heat exchanger 123 may be disposed in the left-and-right direction. The compressor 121, the second fan 125, and the second heat exchanger 123 may be disposed in a line.

The second fan 125 may be disposed between the compressor 121 and the second heat exchanger 123.

The second fan 125 may include an axial fan.

The first heat exchange portion of the heat exchange device 100 may be disposed in the rear region of the heat exchange device 100. The first heat exchange portion may include the first heat exchanger 220 and the first fans 251 and 252.

The first heat exchange portion further includes a heat exchanger case 200 defining a space (case accommodation portion) 205 accommodating the first heat exchanger 220. The heat exchanger case 200 may be separated from the second heat exchange portion and configured to have an insulating wall with insulating material 213.

The case accommodation portion 205 of the heat exchanger case 200 may define at least a part of the second storage space 16.

The heat exchanger case 200 includes a case body 210 provided in the rear of the second heat exchange portion. The case body 210 may have a polyhedral shape (e.g., a hexahedral shape) with an opened upper end portion.

The first heat exchanger 220 may be disposed inside the heat exchanger case 200.

The fluid, which is heat-exchanged while passing through the first heat exchanger 220, may flow to the duct 30 of the storehouse body 10 through the first fan assembly 250 and may be supplied to the first storage space 15 through the duct discharge hole 35.

The heat exchange device 100 may further include a base 110 on which at least one of the first heat exchange portion and the second heat exchange portion is installed. The base 110 may have a shape corresponding to the lower end portion of the storehouse body 10 and may include a plate.

It is shown that the first and second heat exchange portions are installed on the base 110 together. However, unlike this, the first and second heat exchange portions may be installed on separate bases, and the first heat exchange portion or the second heat exchange portion may be installed on the ground without a base.

The heat exchange device 100 may further include a tray 130 for collecting condensed water. The tray 130 may include a fluid collecting surface for collecting the condensed water and an edge portion protruding upward from the edge of the fluid collecting surface to prevent overflow of the condensed water.

The heat exchanger case 200 may be seated on the upper side of the tray 130.

A drain hole 218 through which condensed water is discharged is defined in the bottom surface of the heat exchanger case 200. The drain hole 218 may be defined in the bottom surface of the heat exchanger case 200, and the condensed water may fall to the tray 130 through the drain hole 218.

A defrost heater 235 may be provided under the first heat exchanger 220. The defrost heater 235 may be placed on the inner bottom surface of the heat exchanger case 200. Condensed water generated by the driving of the defrost heater 235 may be drained to the tray 130 through the drain hole 218.

However, the position of the defrost heater 235 is limited thereto. In addition, the defrost heater 235 may be omitted and the defrosting may be performed by refrigerant heat circulating in the refrigeration cycle.

The storehouse 1 may include a first passage through which the fluid flows in the inside of the first wall of the first storage space 15 or in the vicinity of the first wall of the first storage space 15. The storehouse 1 may include a second passage through which the fluid flows in the inside of the second wall of the second storage space 16 or in the vicinity of the second wall of the second storage space 16. The second storage space 16 may be provided to be fluidly connected to the first storage space 15.

The second passage may include an inlet passage configured to guide the fluid in the outer space of the second storage space 16 to flow to the inner space of the second storage space 16.

An inlet portion 51, through which the fluid in the first storage space 15 is introduced into the second storage space 16, may be defined in the partition wall 50. The inlet portion 51 may define the inlet passage of the second passage.

The inlet portion 51 may pass through the partition wall 50 to communicate with the second storage space 16 of the heat exchange device 100.

For example, the inlet portion 51 may include a hole defined to be long in the left-and-right direction.

A suction connector 260 may be provided in the inlet portion 51. For example, the suction connector 260 may be inserted into the inlet portion 51. The suction connector 260 may define at least a part of the inlet passage of the second passage.

The suction connector 260 may extend from the upper side of the first heat exchanger 220 toward the first storage space 15.

The suction connector 260 may include a connector body 261 to be inserted into the inlet portion 51. The connector body 261 may be formed to penetrate in the vertical direction to define a connector passage 265 through which the fluid flows.

The suction connector 260 may include a connector flange 263 extending from the upper end portion of the connector body 261 in the horizontal direction. The connector flange 263 may be supported on the partition wall 50.

The upper end portion of the suction connector 260 may define a suction port communicating with the first storage space 15, and the fluid in the first storage space 15 may be introduced into the suction connector 260 through the suction port.

The lower end portion of the suction connector 260 may be located adjacent to the upper surface of the first heat exchanger 220.

The suction connector 260 may be located at the front end portion of the first heat exchanger 220 defining the inlet side of the fluid, and may introduce the fluid into the first heat exchanger 220.

The first heat exchanger 220 may be provided in a shape lying inside the heat exchanger case 200. The width of the first heat exchanger 220 in the front-and-rear direction (X-axis direction) may be greater than the height in the vertical direction (Y-axis direction).

The fan assembly 250 may be provided above the first heat exchanger 220.

The fan assembly 250 may include first fans 251 and 252 configured as an axial fan.

The first fans 251 and 252 may be disposed to lie in the horizontal direction. In other words, the axial direction of the first fans 251 and 252 may be configured to face the vertical direction.

The central axis of the first fans 251 and 252 may be formed to pass through the rear space of the first heat exchanger 220, that is, the second space 205*b*. The fluid passing through the second heat exchanger 220 may be introduced upward in the second space 205*b* and may be sucked in the axial direction of the first fans 251 and 252.

The first fans 251 and 252 may include a plurality of fans, and the plurality of fans may be disposed in the left-and-right direction.

The second storage space 16 in which the first heat exchanger 220 is accommodated may include the first space 205*a* and the second space 205*b*. The first space 205*a* may be a space in which the first heat exchanger 220 is located. The second space 205*b* is a space in which the fluid passing through the first heat exchanger 220 is directed to the first fans 251 and 252, and may be understood as a passage between the first fans 251 and 252 in the first heat exchanger 220.

The fluid in the inner space of the second storage space 16 may be provided to flow toward the first passage after passing through the second passage.

The second passage may include a first through hole in contact with the second storage space 16, a second through hole in contact with the first passage, and a portion connecting the first and second through holes.

The first through hole may provide a path through which the fluid in the inner space of the second storage space 16 flows to the inner space of the second passage. The second through hole may provide a path through which the fluid in the inner space of the second passage flows to the first passage.

In the partition wall 50, an outlet portion 58 through which the fluid in the inner space of the second storage space 16 is discharged may be defined.

For example, the outlet portion 58 may define a fan accommodation portion in which the first fans 251 and 252 are located. A part of the partition wall 50 may vertically penetrate through the fan accommodation portion to define a fluid passage.

A discharge connector 270 may be provided at the outlet side of the outlet portion 58. The discharge connector 270 may be configured to connect the outlet portion 58 to the first passage. For example, the first passage may include a duct 30 disposed in the first storage space 15.

The duct 30 may define a duct inlet portion 33 through which the fluid passing through the discharge connector 270 is introduced. The duct inlet portion 33 may be connected to a connector discharge hole 276*b* of the discharge connector 270.

The duct inlet portion 33 may define a suction hole of the duct 30.

The discharge connector 270 may be understood as a portion connecting the outlet portion 58 to the duct inlet portion 33.

The discharge connector 270 may include two connector side walls 271 and a connector rear wall 274.

A connector inlet hole 276*a* through which the fluid passing through the outlet portion 58 flows into the discharge connector 270 may be defined at the lower end portion of the connector side wall 271.

A connector discharge hole 276*b* for discharging the fluid to the duct inlet portion 33 may be defined in the connector rear wall 274.

The connector inlet hole 276*a* is a portion connected to the outlet portion 58, and may be defined adjacent to the first through hole or may constitute at least a part of the first through hole.

The connector discharge hole 276*b* is a portion connected to the duct inlet portion 33, and may be defined adjacent to the second through hole or may constitute at least a part of the second through hole.

The discharge connector 270 may further include a support wall 275 bent backward from the connector rear wall 274. The support wall 275 may support the duct 30.

An embodiment of the position of the discharge connector 270 will be described. However, this embodiment constitutes optional features, and may be provided at a different location if it can generate a flow.

For example, the discharge connector 270 may be provided above the first fans 251 and 252.

Alternatively, the discharge connector 270 may be located above the partition wall 50.

Alternatively, the discharge connector 270 may be provided on the rear wall of the first storage space 15 and coupled to the duct 30.

The first through hole may be spaced apart from the second through hole in the X-axis direction. For example, the center of the connector inlet hole 276*a* may be spaced apart from the center of the connector discharge hole 276*b* in the X-axis direction.

The first through hole may be provided to be closer to the door 20 than the second through hole. For example, the center of the connector inlet hole 276*a* may be provided to be closer to the door 20 than the center of the connector discharge hole 276*b*.

The second through hole may be provided to be closer to the first passage than the first through hole. For example, the connector discharge hole 276*b* may be provided to be closer to the duct 30 than the connector inlet hole 276*a*.

The second through hole may be provided to be aligned with the suction hole of the first passage. For example, the connector discharge hole 276*b* may be provided to be aligned with the duct inlet portion 33 of the duct 30.

The first through hole may be spaced apart from the second through hole in the vertical direction (Y-axis direction) perpendicular to the horizontal direction (X-axis direction). For example, the connector inlet hole 276*a* may be spaced apart from the connector discharge hole 276*b* in the Y-axis direction.

The first through hole may be disposed in a state of being spaced apart from the second through hole in the X-axis direction perpendicular to the Y-axis direction. For example, the center of the connector inlet hole 276*a* may be spaced apart from the center of the connector discharge hole 276*b* in the X-axis direction.

The direction in which the fluid flows in the second passage may include a first portion in which the fluid flows in the Y-axis direction and a second portion in which the fluid flows in the X-axis direction. The direction in which the fluid flows in the second passage may include a portion in which the fluid flows in an inclined direction that is an angle between the Y-axis direction and the X-axis direction.

The direction in which the fluid flows inside the discharge connector 270 includes a first portion in which the fluid discharged from the second storage space 16 flows upward (Y-axis direction) and a second portion in which the fluid flows backward (X-axis direction).

The discharge connector 270 may include a guide wall 273 that guides the fluid to flow from the connector inlet hole 276*a* toward the connector discharge hole 276*b* in an inclined direction that is an angle between the Y-axis direction and the X-axis direction.

The guide wall 273 may include a guide surface extending obliquely or roundly in a direction toward an angle between the Y-axis direction and the X-axis direction.

In a broad sense, the guide wall 273 may be understood as indicating a portion including the connector side wall 271, the connector rear wall 274, and the guide surface. In one example, the guide wall 273 may include a duct.

In one example, the guide wall 273 may include a guide surface rearward inclined or rounded so that the fluid flowing upward through the first fans 251 and 252 can be redirected to the rear toward the duct 30.

A duct passage 272 through which the fluid flows may be defined in the discharge connector 270.

The second passage may be disposed to be exposed to the inner space of the first storage space 15, or may be disposed to be exposed to the inner space of the second storage space 16. For example, the discharge connector 270 may be disposed to be exposed to the inner space of the first storage space 15.

After the second storage space 16 is coupled to the first storage space 15, the second passage may be disposed such that the first passage and the second passage are connected through the inner space of the first storage space 15.

After the second storage space 16 is coupled to the first storage space 15, the second passage may be disposed such that the first passage and the second passage are connected through the inner space of the second storage space 15.

The connector inlet hole 276*a* of the discharge connector 270 may be understood as defining the "discharge hole" from the viewpoint of the second storage space 16. The connector discharge hole 276*b* of the discharge connector 270 may be understood as defining the "inlet hole" from the viewpoint of the first passage of the first storage space 15.

An angle (θ1) between an imaginary line (l1) passing through the center of the connector inlet hole 276*a* and an imaginary line (l2) passing through the center of the connector discharge hole 276*b* may be greater than 0 degrees and less than 180 degrees.

The flow of the fluid circulating in the first storage space 15 and the second storage space 16 according to the driving of the first fans 251 and 252 will be briefly described.

When the first fans 251 and 252 are driven, the fluid in the inner space of the first storage space 15 is discharged and introduced into the suction connector 260 and is then introduced into the inside of the second storage space 16. For example, the fluid may be introduced into the heat exchanger case 200.

The suction connector 260 may be located adjacent to the upper surface of the front end portion of the first heat exchanger 220, and the fluid discharged from the suction connector 260 may be supplied to the upper surface side of the front end portion of the first heat exchanger 220.

The fluid may be introduced into the first heat exchanger 220 through the front end portion of the first heat exchanger 220 and may be heat-exchanged and then discharged through the rear end portion of the first heat exchanger 220. The fluid discharged from the first heat exchanger 220 may be sucked in the axial direction of the first fans 251 and 252 via the second space 205*b*.

The fluid discharged in the axial direction of the first fans 251 and 252 is introduced into the duct 30 through the discharge connector 270. The fluid in the duct 30 may be supplied to the first storage space 15 through the duct discharge hole 35.

Figure 7:
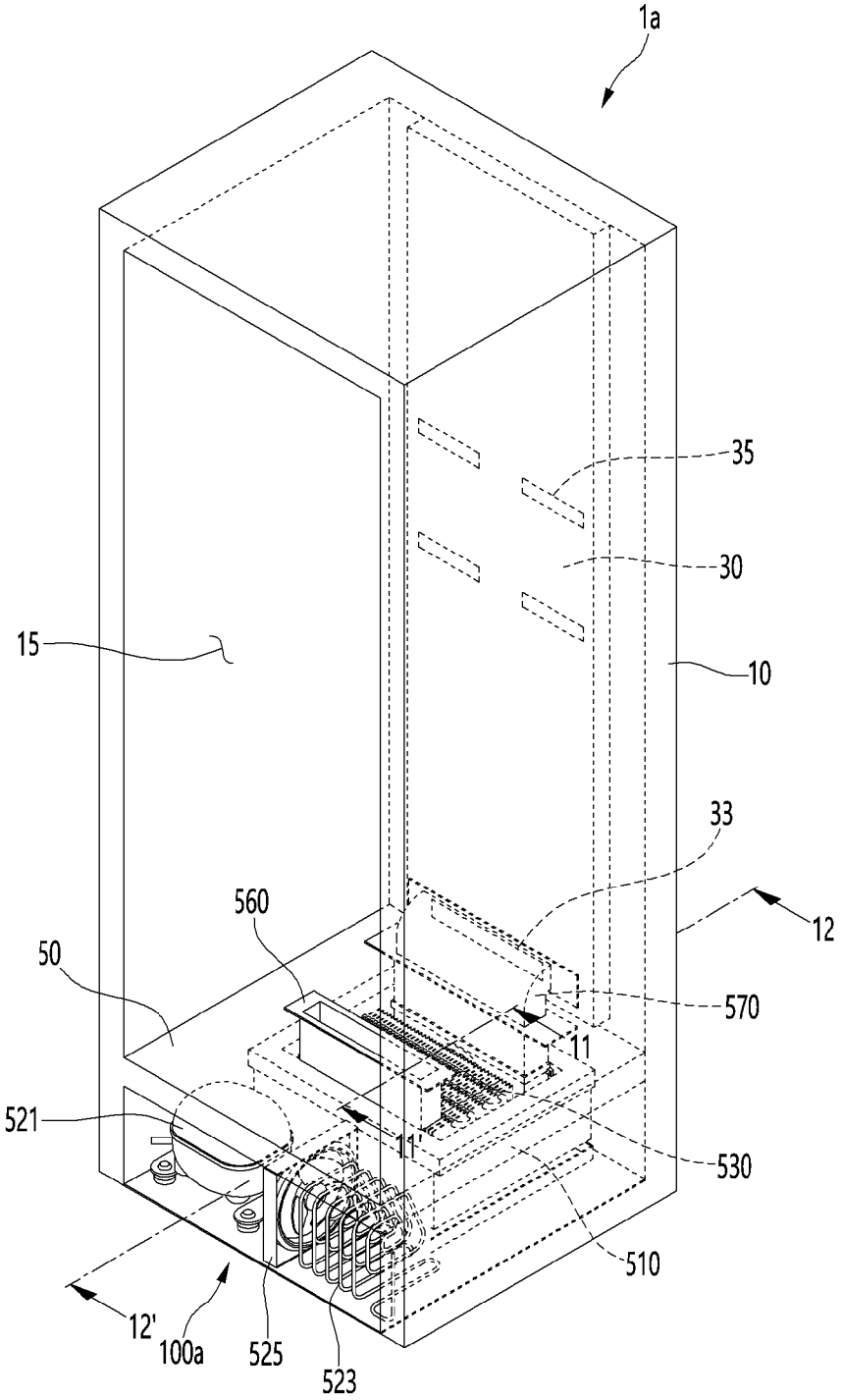
FIG. 7 is a front perspective view of a storehouse body according to a second embodiment of the present disclosure.
Figure 8:
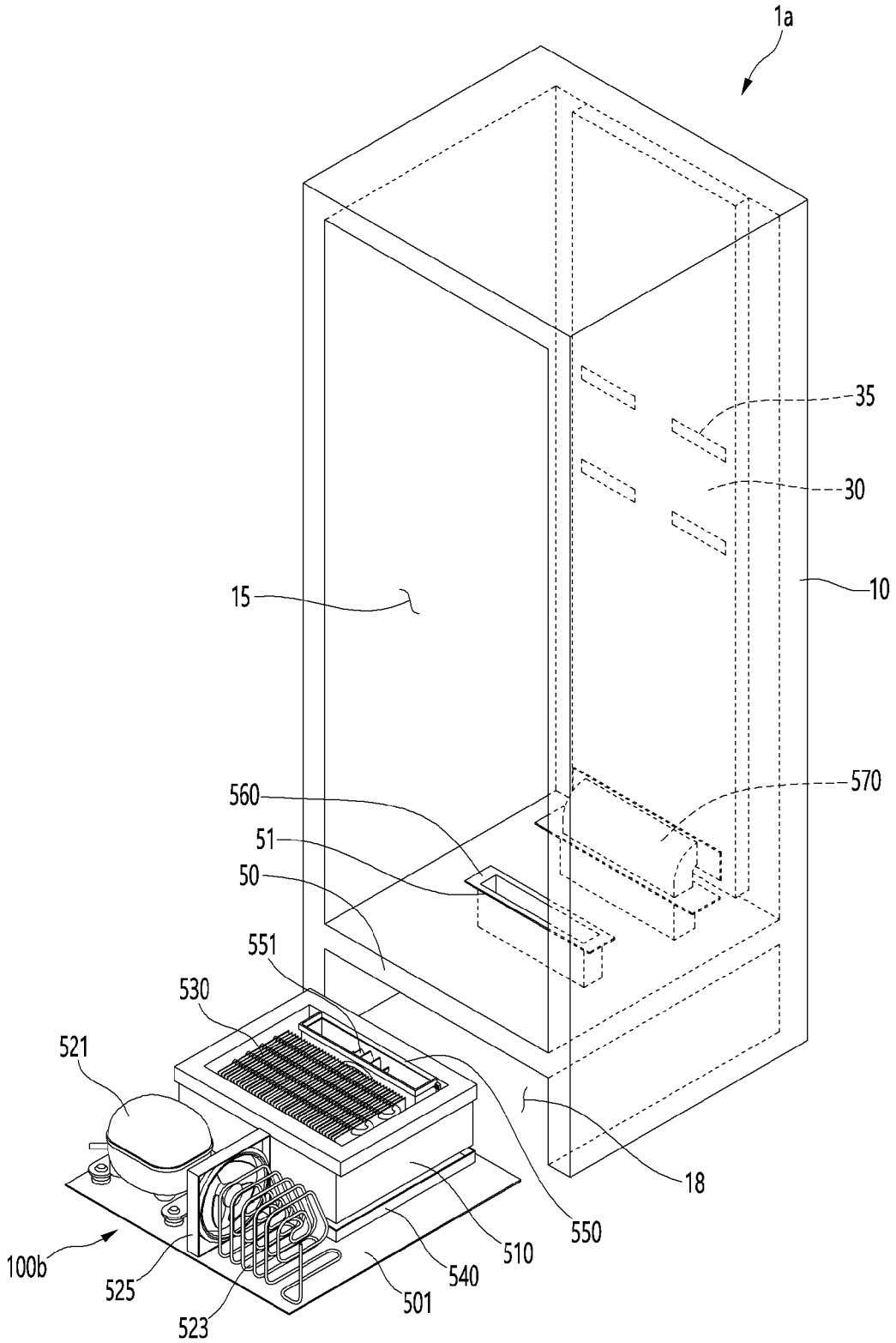
FIG. 8 is an exploded perspective view of a storehouse body and a heat exchange device according to the second embodiment of the present disclosure.
Figure 9:
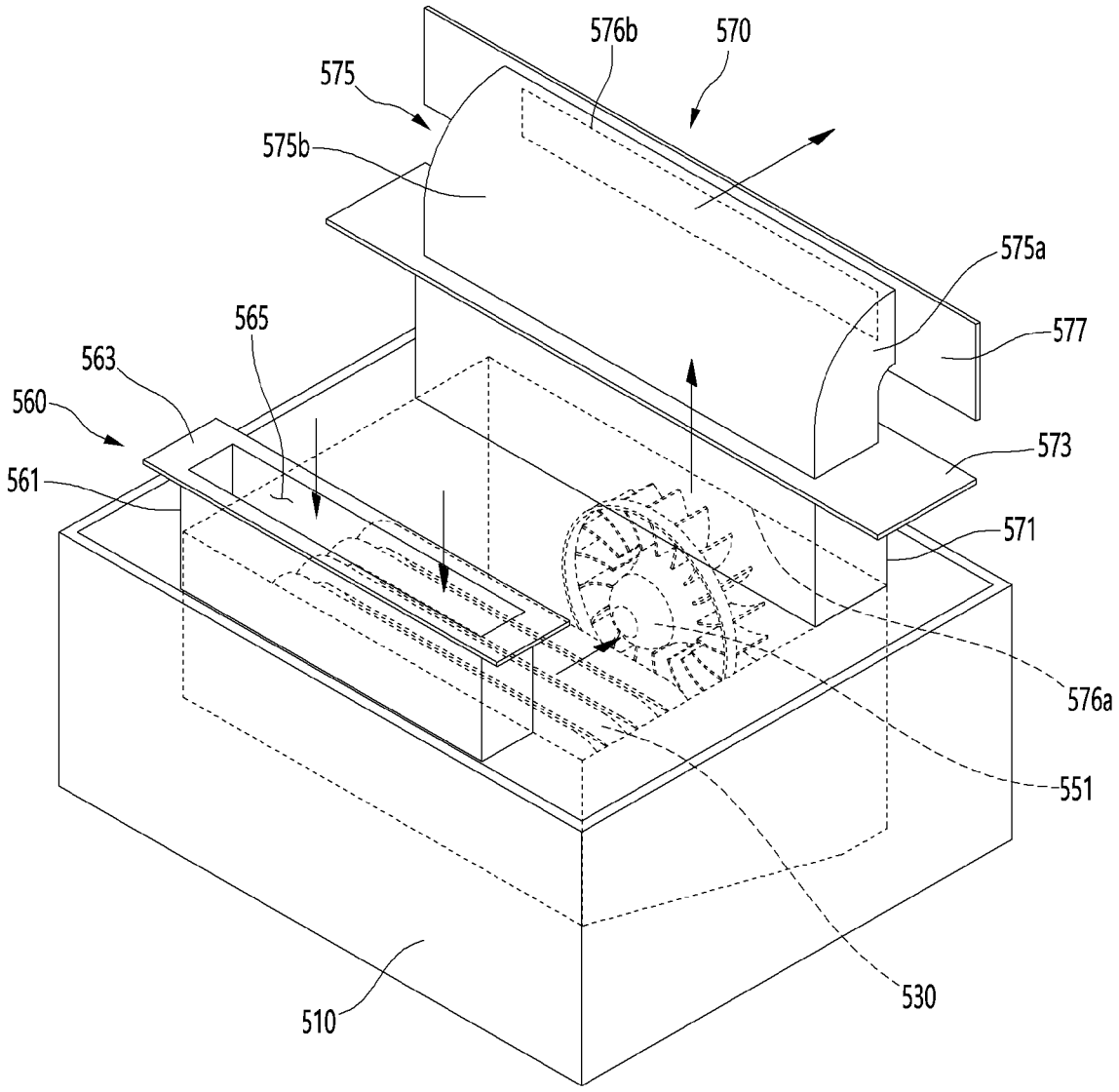
FIG. 9 is a perspective view of a heat exchange device according to the second embodiment of the present disclosure.
Figure 10:
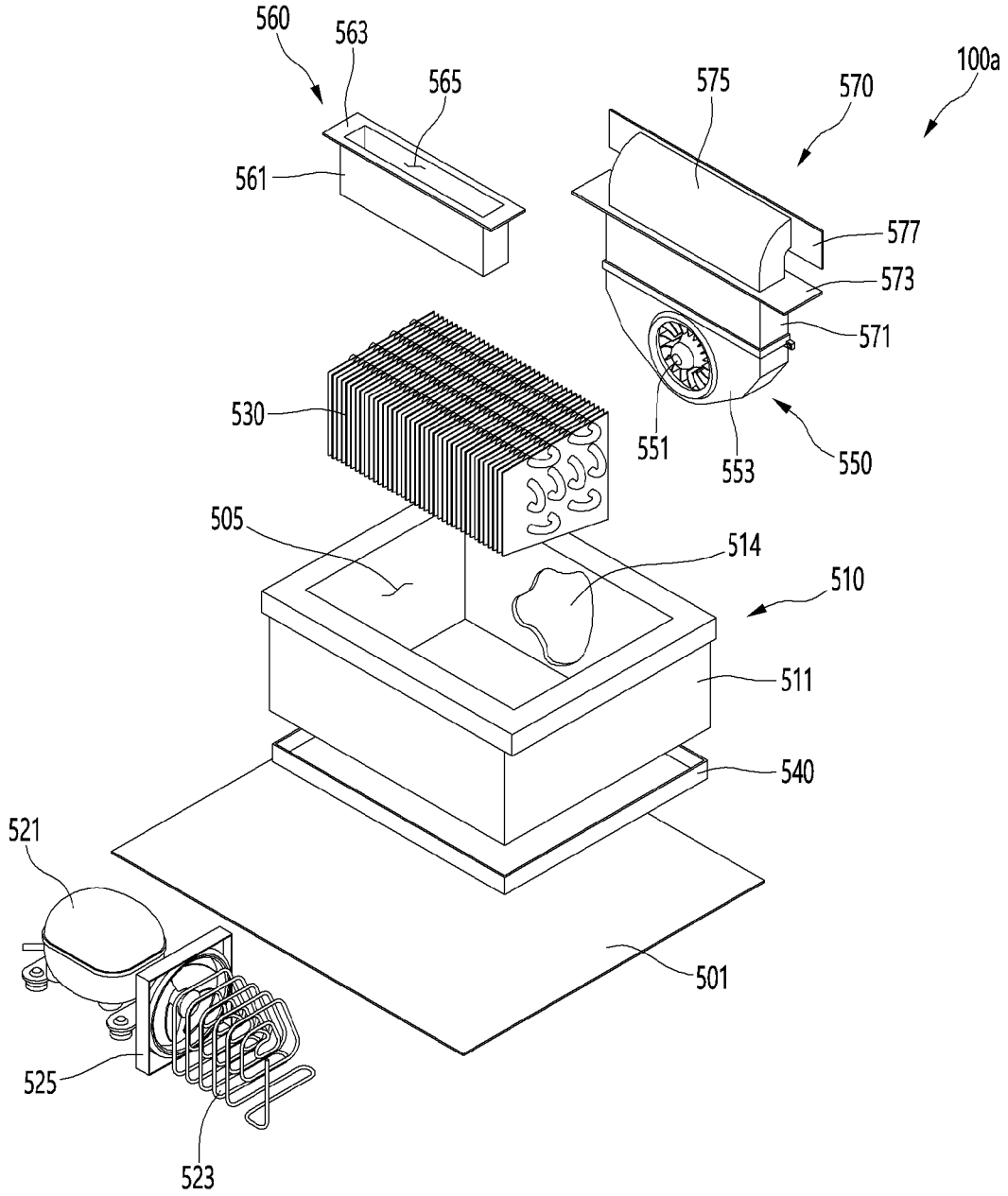
FIG. 10 is an exploded perspective view of a heat exchange device according to the second embodiment of the present disclosure.
Figure 11:
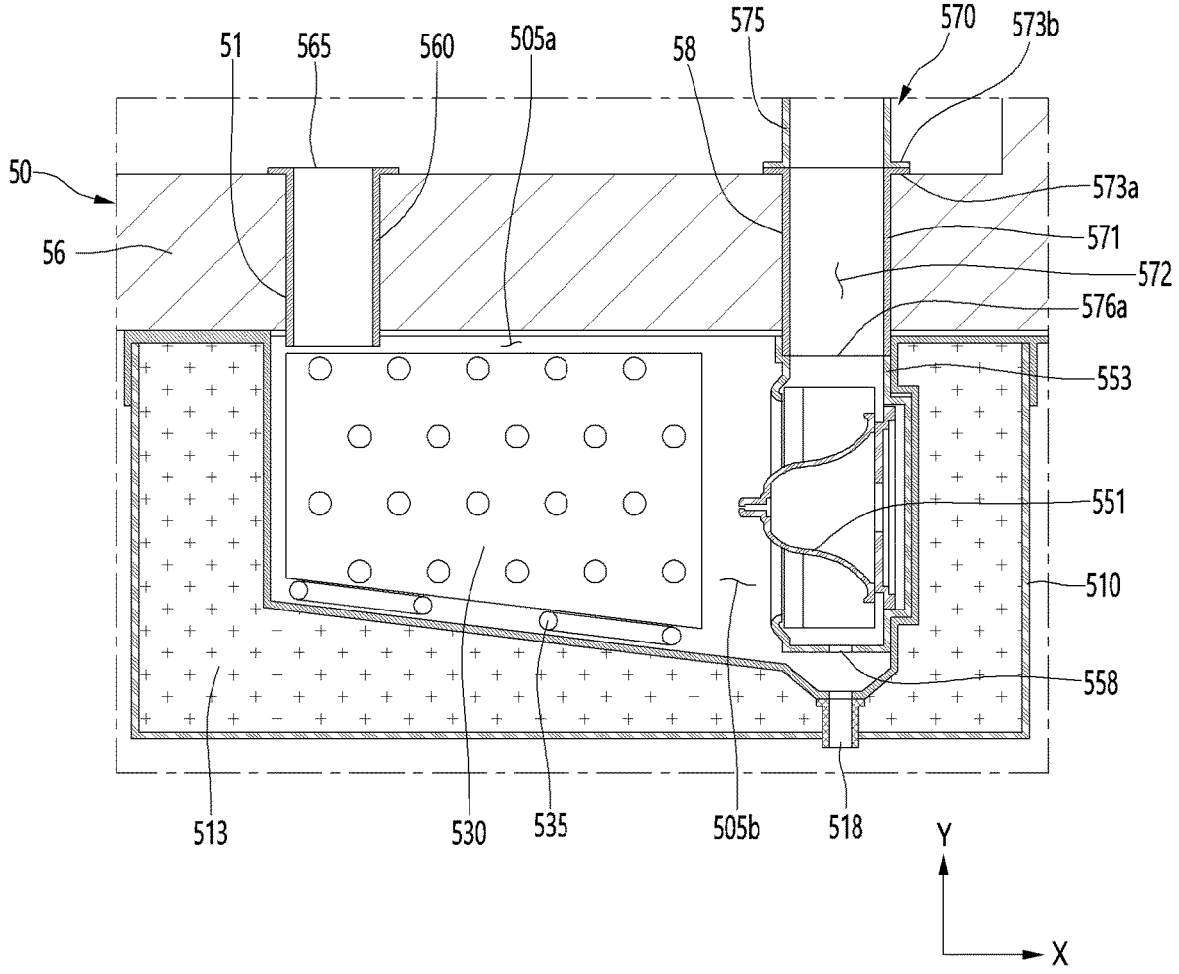
FIG. 11 is a cross-sectional view taken along line 11-11' of FIG. 7.
Figure 12:
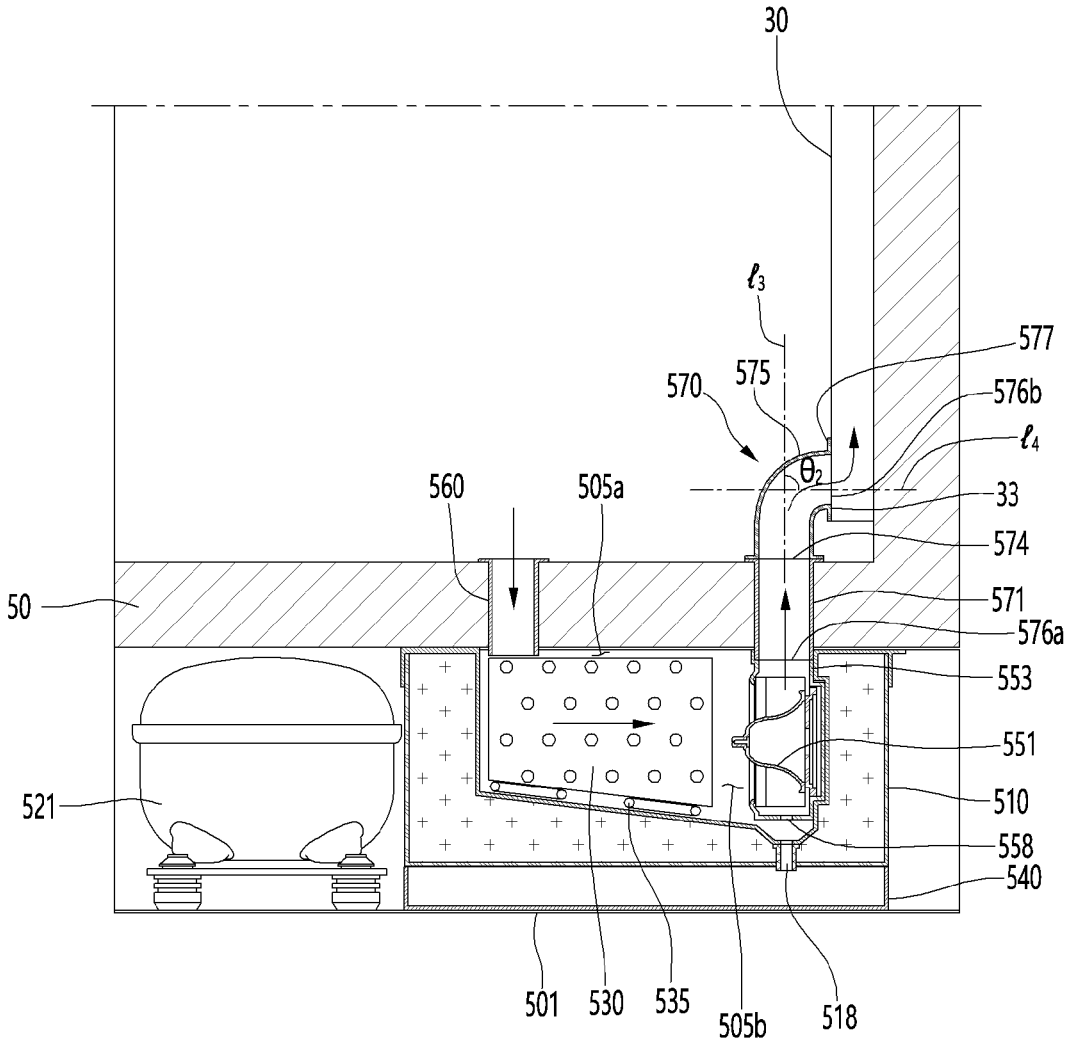
FIG. 12 is a cross-sectional view taken along line 12-12' of FIG. 7.

FIG. 7 is a front perspective view of a storehouse body according to a second embodiment of the present disclosure, FIG. 8 is an exploded perspective view of a storehouse body and a heat exchange device according to the second embodiment of the present disclosure, FIG. 9 is a perspective view of the heat exchange device according to the second embodiment of the present disclosure, FIG. 10 is an exploded perspective view of the heat exchange device according to the second embodiment of the present disclosure, FIG. 11 is a cross-sectional view taken along line 11-11' of FIG. 7, and FIG. 12 is a cross-sectional view taken along line 12-12' of FIG. 7.

Referring to FIGS. 7 to 12, a storehouse 1*a* according to a second embodiment of the present invention may include a heat exchange device 100*a* including a refrigeration cycle part.

The storehouse 1*a* may further include the heat exchange device 100*a* including the refrigeration cycle part.

The refrigeration cycle part may include a first heat exchanger 530 installed in a first storage space 16 as a first heat exchange portion, and a first fan 551 as a fluid generator. The fluid in the first storage space 15 may circulate through a space in which the first heat exchange portion is installed.

For example, the first heat exchanger 530 may include an evaporator, and the first fan 551 may include a cooling fan. In this case, the first heat exchange portion may constitute a cooling portion for generating cold air.

The refrigeration cycle part may include a compressor 521 and a second heat exchanger 523 as a second heat exchange portion, and a second fan 525 as a fluid generator. Outdoor air may circulate in the space in which the second heat exchange portion is installed.

For example, the second heat exchanger 523 may include a condenser, and the second fan 525 may include a condensing fan. In this case, the second heat exchange portion may constitute a heat dissipation portion that dissipates heat.

The heat exchange device 100*a* may be installed in a device accommodation space 18. The device accommodation space 18 may include a second storage space 16 in which the first heat exchanger 530 is installed, and a third storage space 17 in which the second heat exchanger 523 is installed.

The first storage space 15 and the device accommodation space 18 may be separated by a partition wall 50. The partition wall 50 may be located between the first storage space 15 and the device accommodation space 18. The description of the second embodiment can be applied to the description of the partition wall 50 and the device accommodation space 18.

A cover may be provided in front of the heat dissipating portion. The description of the cover 150 in the first embodiment can be applied to the description of the cover in the present embodiment.

The heat exchange device 100*a* may be located at the lower end portion of the storehouse body 10*a*.

The first heat exchange portion further includes a heat exchanger case 510 defining a space (case accommodation portion) 505 accommodating the first heat exchanger 530. The heat exchanger case 510 may be separated from the second heat exchange portion and configured to have an insulating wall with insulating material 513.

The case accommodation portion 505 of the heat exchanger case 510 may define at least a part of the second storage space 16.

The heat exchanger case 510 includes a case body 511 provided in the rear of the second heat exchange portion. The case body 511 may have a polyhedral shape (e.g., a hexahedral shape) with an opened upper end portion.

The first heat exchanger 530 may be disposed inside the heat exchanger case 510.

The fluid, which is heat-exchanged while passing through the first heat exchanger 530, may flow to the duct 30 of the storehouse body 10 through the fan assembly 550 and may be supplied to the first storage space 15 through the duct discharge hole 35.

The heat exchange device 100*a* may further include a base 501 on which at least one of the first heat exchange portion and the second heat exchange portion is installed. The base 501 may have a shape corresponding to the lower end portion of the storehouse body 10 and may include a plate.

It is shown that the first and second heat exchange portions are installed on the base 501 together. However, unlike this, the first and second heat exchange portions may be installed on separate bases, and the first heat exchange portion or the second heat exchange portion may be installed on the ground without a base.

The heat exchange device 100*a* may further include a tray 540 for collecting condensed water. The tray 540 may include a fluid collecting surface for collecting the condensed water and an edge portion protruding upward from the edge of the fluid collecting surface to prevent overflow of the condensed water.

The heat exchanger case 510 may be seated on the upper side of the tray 540.

A drain hole 518 through which condensed water is discharged is defined in the bottom surface of the heat exchanger case 510. The drain hole 518 may be defined in the bottom surface of the heat exchanger case 510, and the condensed water may fall to the tray 540 through the drain hole 518.

A defrost heater 535 may be provided under the first heat exchanger 530. The defrost heater 535 may be placed on the inner bottom surface of the heat exchanger case 510. Condensed water generated by the driving of the defrost heater 535 may be drained to the tray 130 through the drain hole 518.

However, the position of the defrost heater 535 is limited thereto. In addition, the defrost heater 535 may be omitted and the defrosting may be performed by refrigerant heat circulating in the refrigeration cycle.

The storehouse 1*a* may include a first passage through which the fluid flows in the inside of the first wall of the first storage space 15 or in the vicinity of the first wall of the first storage space 15. The storehouse 1*a* may include a second passage through which the fluid flows in the inside of the second wall of the second storage space 16 or in the vicinity of the second wall of the second storage space 16. The second storage space 16 may be provided to be fluidly connected to the first storage space 15.

The second passage may include an inlet passage configured to guide the fluid in the outer space of the second storage space 16 to flow to the inner space of the second storage space 16.

An inlet portion 51, through which the fluid in the first storage space 15 is introduced into the second storage space 16, may be defined in the partition wall 50. The inlet portion 51 may define the inlet passage of the second passage.

The inlet portion 51 may pass through the partition wall 50 to communicate with the second storage space 16 of the heat exchange device 100*a*.

For example, the inlet portion 51 may include a hole defined to be long in the left-and-right direction.

A suction connector 560 may be provided in the inlet portion 51. For example, the suction connector 560 may be inserted into the inlet portion 51. The suction connector 560 may define at least a part of the inlet passage of the second passage.

The suction connector 560 may extend from the upper side of the first heat exchanger 530 toward the first storage space 15.

The suction connector 560 may include a connector body 561 to be inserted into the inlet portion 51. The connector body 561 may be formed to penetrate in the vertical direction to define a connector passage 565 through which the fluid flows.

The suction connector 560 may include a connector flange 563 extending from the upper end portion of the connector body 561 in the horizontal direction. The connector flange 563 may be supported on the partition wall 50.

The upper end portion of the suction connector 560 may define a suction port communicating with the first storage space 15, and the fluid in the first storage space 15 may be introduced into the suction connector 560 through the suction port.

The lower end portion of the suction connector 560 may be located adjacent to the upper surface of the first heat exchanger 220.

The suction connector 560 may be located at the front end portion of the first heat exchanger 530 defining the inlet side of the fluid, and may introduce the fluid into the first heat exchanger 530.

The second storage space 16 formed in the heat exchanger case 510 defines an accommodation space 505. The accommodation space 505 may include a first space 505*a* in which the first heat exchanger 530 is located, and a second space 505*b* which defines an outlet region of the first heat exchanger 530 and defines a passage through which the fluid passing through the first heat exchanger 530 flows.

The first heat exchanger 530 may be provided in a shape lying inside the heat exchanger case 510. The width of the first heat exchanger 530 in the front-and-rear direction may be greater than the height in the vertical direction.

The fan assembly 550 may be provided inside the heat exchanger case 510. The fan assembly 550 may be provided in the second space 505*b*.

The fan assembly 550 may include a first fan 551 configured as an axial fan.

The first fan 551 may be disposed to be erected in the horizontal direction. In other words, the axial direction of the first fan 551 may be configured to face the front-and-rear direction.

The central axis of the first fan 551 may be formed to pass through the first heat exchanger 530 in the front-and-rear direction. The fluid passing through the first heat exchanger 530 may be introduced in the axial direction (X-axis direction) of the first fan 551 in the second space 505*b* and may be discharged in the radial direction (Y-axis direction).

The fan assembly 550 may include a shroud 553 on which the first fan 551 is installed. The cooling fan 551 may be located inside the shroud 553.

A fan seating portion 514 on which the fan assembly 550 is seated may be recessed in the inner surface of the heat exchanger case 510. The fan seating portion may be formed on the inner rear surface of the heat exchanger case 510.

A defrost water hole 558 for discharging defrost water generated by the first fan 551 may be defined in the shroud 553.

The defrost water hole 558 may be defined at the lower end of the shroud 553.

The fluid in the inner space of the second storage space 16 may be provided to flow toward the first passage after passing through the second passage.

The second passage may include a first through hole in contact with the second storage space 16, a second through hole in contact with the first passage, and a portion connecting the first and second through holes.

The first through hole may provide a path through which the fluid in the inner space of the second storage space 16 flows to the inner space of the second passage. The second through hole may provide a path through which the fluid in the inner space of the second passage flows to the first passage.

In the partition wall 50, an outlet portion 58 through which the fluid in the inner space of the second storage space 16 is discharged may be defined.

For example, in the outlet portion 58, a part of the partition wall 50 may penetrate vertically to define a fluid passage.

A discharge connector 570 defining an inner passage 572 may be provided in the outlet portion 58. The discharge connector 570 may be configured to connect the outlet portion 58 to the first passage. For example, the first passage may include a duct 30 disposed in the first storage space 15.

The duct 30 may define a duct inlet portion 33 through which the fluid passing through the discharge connector 570 is introduced. The duct inlet portion 33 may be connected to a connector discharge hole 576*b* of the discharge connector 570.

The duct inlet portion 33 may define a suction hole of the duct 30.

The discharge connector 270 may be understood as a portion connecting the outlet portion 58 to the duct inlet portion 33.

For example, the discharge connector 570 may pass through the partition wall 50 and extend upward from the partition wall 50.

The discharge connector 570 may be coupled to the duct 30 at the rear wall of the first storage space 15.

The discharge connector 570 includes a fan coupling portion 571 coupled to the fan assembly 550. The fan coupling portion 571 may define a passage through which the fluid passing through the first fan 551 flows. For example, the fan coupling portion 571 may include a duct.

The fan coupling portion 571 may be inserted into the outlet portion 58.

The discharge connector 570 may include a connector flange 573 extending from the upper end of the fan coupling portion 571 in the horizontal direction. The connector flange 573 may be supported on the partition wall 50.

The connector flange 573 may include a first flange 573*a* integrally provided with the fan coupling portion 571 and a second flange 573*b* integrally provided with the extension portion 575.

When the fan coupling portion 571 is inserted into the outlet portion 58, the first flange 573*a* may be supported on the partition wall 50. When the extension portion 575 is coupled to the fan coupling portion 571, the second flange 573*b* may come into contact with the first flange 573*a*.

A connector inlet hole 576*a* through which the fluid passing through the first fan 551 is introduced into the discharge connector 270 may be defined at the lower end portion of the fan coupling portion 571.

A connector discharge hole 576*b* through which the fluid is discharged to the duct inlet portion 33 may be defined at the rear end portion of the discharge connector 570.

The connector inlet hole 576*a* may be defined adjacent to the first through hole of the second passage, or may constitute at least a part of the first through hole.

The connector discharge hole 576*b* is a portion connected to the duct inlet portion 33, and may be defined adjacent to the second through hole or may constitute at least a part of the second through hole.

The first through hole may be spaced apart from the second through hole in the X-axis direction. For example, the center of the connector inlet hole 576*a* may be spaced apart from the center of the connector discharge hole 276*b* in the X-axis direction.

The first through hole may be provided to be closer to the door 20 than the second through hole. For example, the center of the connector inlet hole 576*a* may be provided to be closer to the door 20 than the center of the connector discharge hole 576*b*.

The second through hole may be provided to be closer to the first passage than the first through hole. For example, the connector discharge hole 576*b* may be provided to be closer to the duct 30 than the connector inlet hole 576*a*.

The second through hole may be provided to be aligned with the suction hole of the first passage. For example, the connector discharge hole 576*b* may be provided to be aligned with the duct inlet portion 33 of the duct 30.

The first through hole may be spaced apart from the second through hole in the vertical direction (Y-axis direction) perpendicular to the horizontal direction (X-axis direction). For example, the connector inlet hole 576*a* may be spaced apart from the connector discharge hole 576*b* in the Y-axis direction.

The first through hole may be disposed in a state of being spaced apart from the second through hole in the X-axis direction perpendicular to the Y-axis direction. For example, the center of the connector inlet hole 576*a* may be spaced apart from the center of the connector discharge hole 576*b* in the X-axis direction.

The direction in which the fluid flows in the second passage may include a first portion in which the fluid flows in the Y-axis direction and a second portion in which the fluid flows in the X-axis direction. The direction in which the fluid flows in the second passage may include a portion in which the fluid flows in an inclined direction that is an angle between the Y-axis direction and the X-axis direction.

The direction in which the fluid flows inside the discharge connector 570 includes a first direction in which the fluid discharged from the second storage space 16 flows upward (Y-axis direction) and a second portion in which the fluid flows backward (X-axis direction).

The discharge connector 570 may include a guide wall 575 that guides the fluid to flow from the connector inlet hole 576*a* toward the connector discharge hole 576*b* in an inclined direction that is an angle between the Y-axis direction and the X-axis direction.

The guide wall 575 may include a guide surface extending obliquely or roundly in a direction toward an angle between the Y-axis direction and the X-axis direction.

In one example, the guide wall 575 may include a guide surface rearward inclined or rounded so that the fluid flowing upward through the first fan 551 can be redirected to the rear toward the duct 30. In one example, the guide wall 575 may include a duct.

The connector discharge hole 576*b* may be defined at the end portion of the guide wall 575.

The discharge connector 570 may further include a duct coupling portion 577 extending outward from the end portion of the guide wall 575. The duct coupling portion 577 may be coupled to the front surface of the duct 30.

The second passage may be disposed to be exposed to the inner space of the first storage space 15, or may be disposed to be exposed to the inner space of the second storage space 16. For example, the discharge connector 570 may be disposed to be exposed to at least one of the inner space of the first storage space 15 and the inner space of the second storage space 16.

After the second storage space 16 is coupled to the first storage space 15, the second passage may be disposed such that the first passage and the second passage are connected through the inner space of the first storage space 15.

After the second storage space 16 is coupled to the first storage space 15, the second passage may be disposed such that the first passage and the second passage are connected through the inner space of the second storage space 15.

The connector inlet hole 576*a* of the discharge connector 570 may be understood as defining the "discharge hole" from the viewpoint of the second storage space 16. The connector discharge hole 576*b* of the discharge connector 570 may be understood as defining the "inlet hole" from the viewpoint of the first passage of the first storage space 15.

An angle (θ2) between an imaginary line (l3) passing through the center of the connector inlet hole 576*a* and an imaginary line (l4) passing through the center of the connector discharge hole 576*b* may be greater than 0 degrees and less than 180 degrees.

The flow of the fluid circulating in the first storage space 15 and the second storage space 16 according to the driving of the first fan 551 will be briefly described.

When the first fan 551 is driven, the fluid in the inner space of the first storage space 15 is discharged and introduced into the suction connector 560 and is then introduced into the inside of the second storage space 16. For example, the fluid may be introduced into the heat exchanger case 510.

The suction connector 560 may be located adjacent to the upper surface of the front end portion of the first heat exchanger 530, and the fluid discharged from the suction connector 560 may be supplied to the upper surface side of the front end portion of the first heat exchanger 530.

The fluid may be introduced into the first heat exchanger 530 through the front end portion of the first heat exchanger 530 and may be heat-exchanged and then discharged through the rear end portion of the first heat exchanger 530. The fluid discharged from the first heat exchanger 530 may be sucked in the axial direction of the first fan 551 via the second space 205*b*.

The fluid discharged in the axial direction of the first fan 551 is introduced into the duct 30 through the discharge connector 570. The fluid in the duct 30 may be supplied to the first storage space 15 through the duct discharge hole 35.

Figure 13:
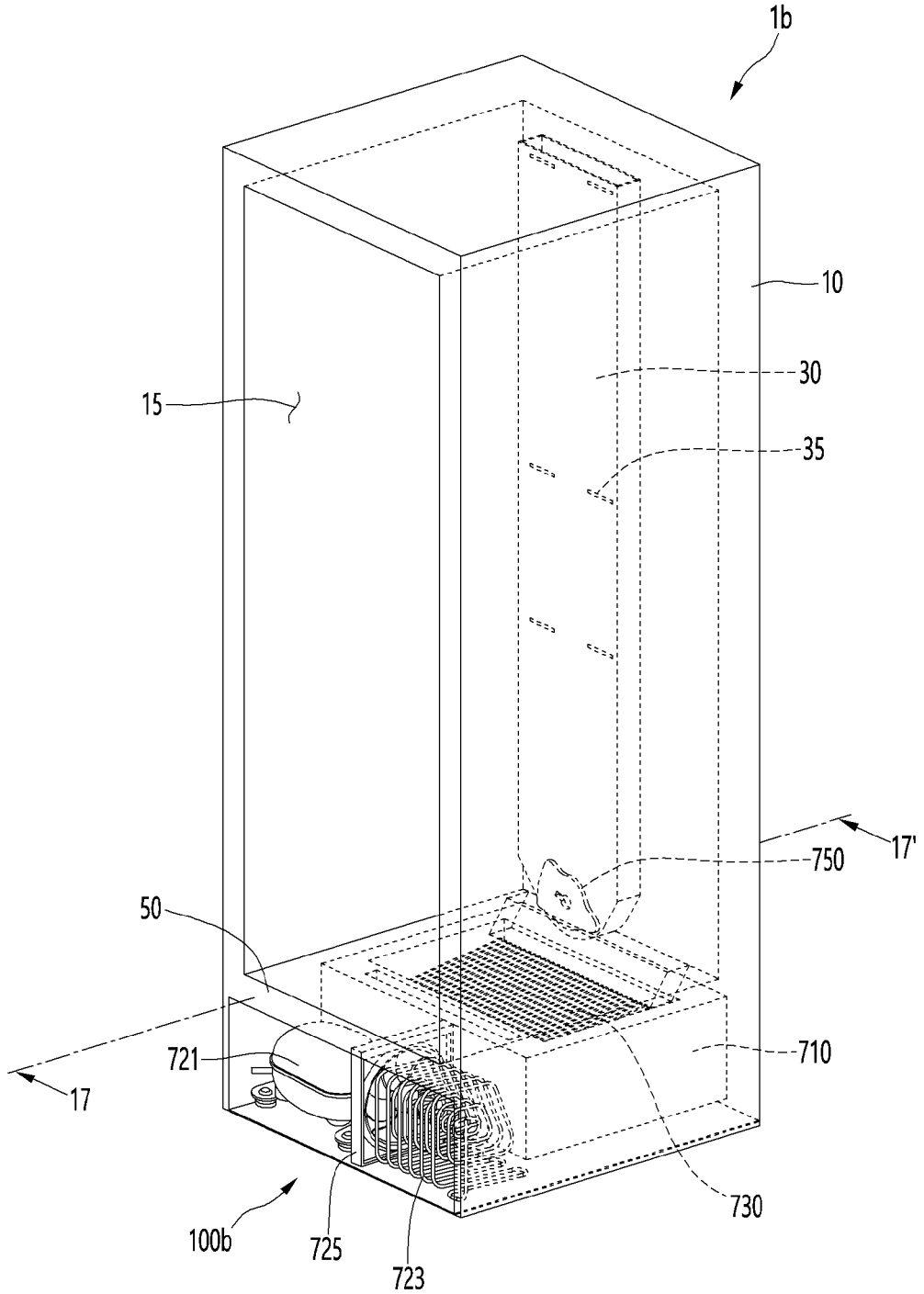
FIG. 13 is a front perspective view of a storehouse body according to a third embodiment of the present disclosure.
Figure 14:
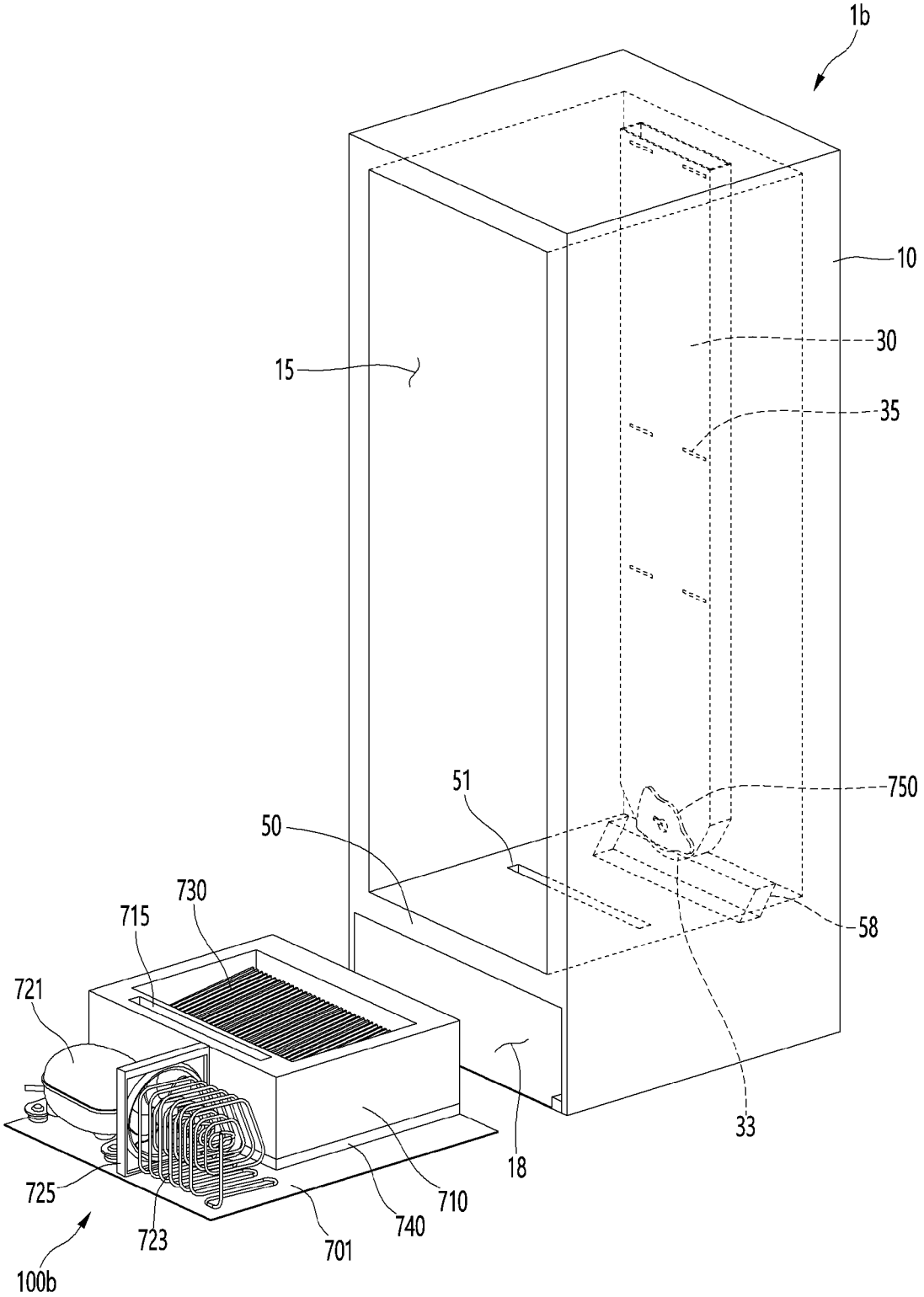
FIG. 14 is an exploded perspective view of a storehouse body and a heat exchange device according to the third embodiment of the present disclosure.
Figure 15:
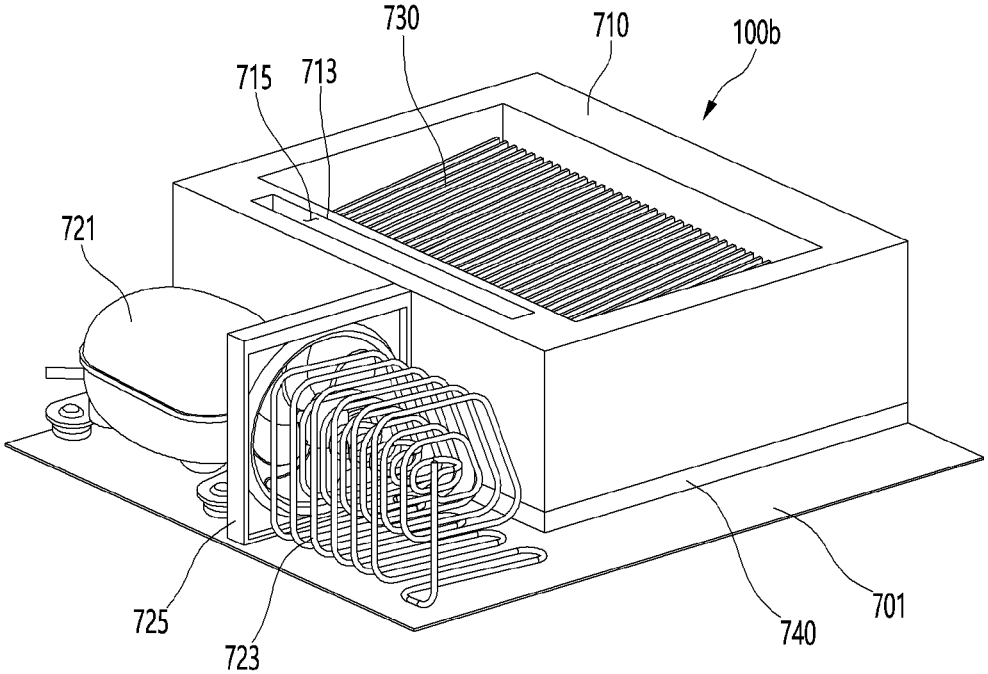
FIG. 15 is a perspective view of a heat exchange device according to the third embodiment of the present disclosure.
Figure 16:
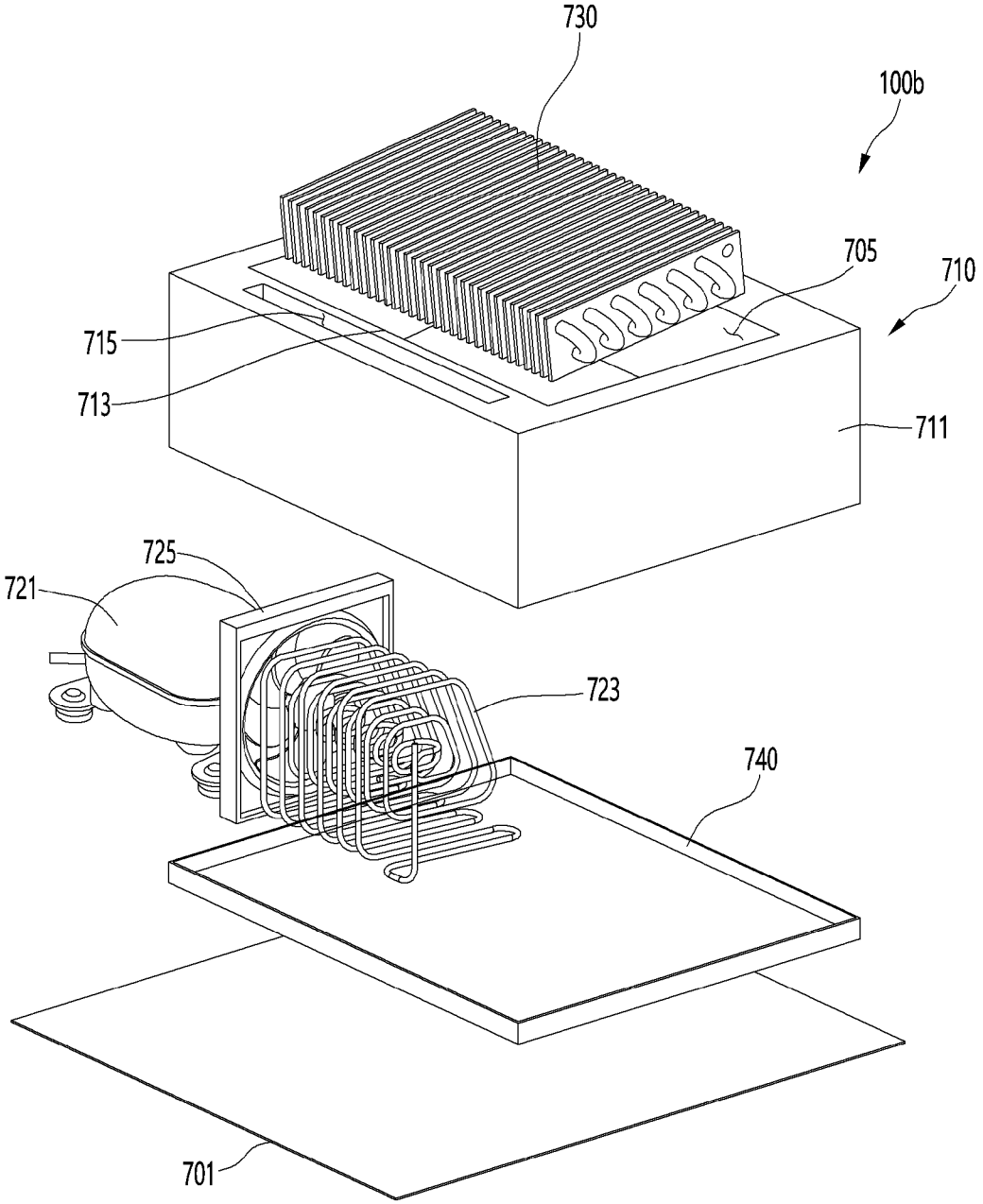
FIG. 16 is an exploded perspective view of a heat exchange device according to the third embodiment of the present disclosure.
Figure 17:
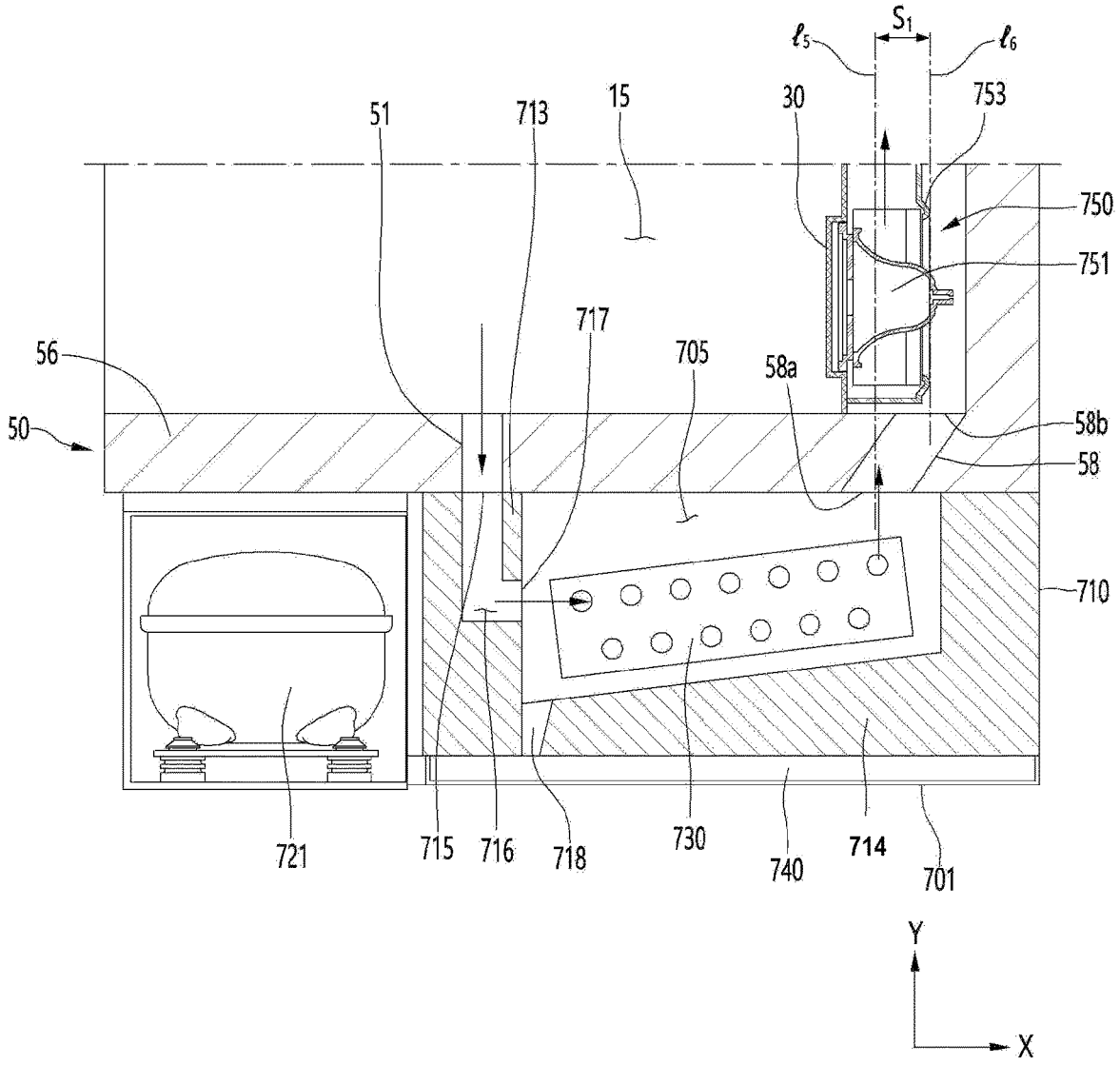
FIG. 17 is a cross-sectional view taken along line 17-17' of FIG. 13.

FIG. 13 is a front perspective view of a storehouse body according to a third embodiment of the present disclosure, FIG. 14 is an exploded perspective view of a storehouse body and a heat exchange device according to the third embodiment of the present disclosure, FIG. 15 is a perspective view of a heat exchange device according to the third embodiment of the present disclosure, FIG. 16 is an exploded perspective view of a heat exchange device according to the third embodiment of the present disclosure, and FIG. 17 is a cross-sectional view taken along line 17-17' of FIG. 13.

Referring to FIGS. 13 to 17, a storehouse 1*b* according to a third embodiment of the present invention may include a heat exchange device 100*a* including a refrigeration cycle part.

The storehouse 1*b* may further include the heat exchange device 100*b* including the refrigeration cycle part.

The refrigeration cycle part may include a first heat exchanger 730 installed in a first storage space 16 as a first heat exchange portion, and a first fan 751 as a fluid generator. The fluid in the first storage space 15 may circulate through a space in which the first heat exchange portion is installed.

For example, the first heat exchanger 730 may include an evaporator, and the first fan 751 may include a cooling fan. In this case, the first heat exchange portion may constitute a cooling portion for generating cold air.

The refrigeration cycle part may include a compressor 721 and a second heat exchanger 723 as a second heat exchange portion, and a second fan 725 as a fluid generator. Outdoor air may circulate in the space in which the second heat exchange portion is installed.

For example, the second heat exchanger 723 may include a condenser, and the second fan 725 may include a condensing fan. In this case, the second heat exchange portion may constitute a heat dissipation portion that dissipates heat.

The heat exchange device 100*b* may be installed in a device accommodation space 18. The device accommodation space 18 may include a second storage space 16 in which the first heat exchanger 730 is installed, and a third storage space 17 in which the second heat exchanger 723 is installed.

The first storage space 15 and the device accommodation space 18 may be separated by a partition wall 50. The partition wall 50 may be located between the first storage space 15 and the device accommodation space 18. The description of the second embodiment can be applied to the description of the partition wall 50 and the device accommodation space 18.

A cover may be provided in front of the heat dissipating portion. The description of the cover 150 in the first embodiment can be applied to the description of the cover in the present embodiment.

The heat exchange device 100*b* may be located at the lower end portion of the storehouse body 10.

The first heat exchange portion further includes a heat exchanger case 710 defining a space (case accommodation portion) 705 accommodating the first heat exchanger 730. The heat exchanger case 710 may be separated from the second heat exchange portion and configured to have an insulating wall with insulating material 714.

The case accommodation portion 505 of the heat exchanger case 710 may define at least a part of the second storage space 16.

The heat exchanger case 710 includes a case body 711 provided in the rear of the second heat exchange portion. The case body 711 may have a polyhedral shape (e.g., a hexahedral shape) with an opened upper end portion.

The first heat exchanger 730 may be disposed inside the heat exchanger case 710.

The fluid, which is heat-exchanged while passing through the first heat exchanger 730, may flow to the duct 30 of the storehouse body 10 through the fan assembly 750 and may be supplied to the first storage space 15 through the duct discharge hole 35.

The heat exchange device 100*b* may further include a base 701 on which at least one of the first heat exchange portion and the second heat exchange portion is installed. The base 110 may have a shape corresponding to the lower end portion of the storehouse body 10 and may include a plate.

It is shown that the first and second heat exchange portions are installed on the base 701 together. However, unlike this, the first and second heat exchange portions may be installed on separate bases, and the first heat exchange portion or the second heat exchange portion may be installed on the ground without a base.

The heat exchange device 100*b* may further include a tray 740 for collecting condensed water. The tray 740 may include a fluid collecting surface for collecting the condensed water and an edge portion protruding upward from the edge of the fluid collecting surface to prevent overflow of the condensed water.

The heat exchanger case 710 may be seated on the upper side of the tray 740.

A drain hole 718 through which condensed water is discharged is defined in the bottom surface of the heat exchanger case 710. The drain hole 718 may be defined in the bottom surface of the heat exchanger case 710, and the condensed water may fall to the tray 740 through the drain hole 718.

The storehouse 1*b* may include a first passage through which the fluid flows in the inside of the first wall of the first storage space 15 or in the vicinity of the first wall of the first storage space 15. The storehouse 1*b* may include a second passage through which the fluid flows in the inside of the second wall of the second storage space 16 or in the vicinity of the second wall of the second storage space 16. The second storage space 16 may be provided to be fluidly connected to the first storage space 15.

The second passage may include an inlet passage configured to guide the fluid in the outer space of the second storage space 16 to flow to the inner space of the second storage space 16.

An inlet portion 51, through which the fluid in the first storage space 15 is introduced into the second storage space 16, may be defined in the partition wall 50. The inlet portion 51 may define the inlet passage of the second passage.

The inlet portion 51 may pass through the partition wall 50 to communicate with the second storage space 16 of the heat exchange device 100*b*.

For example, the inlet portion 51 may include a hole defined to be long in the left-and-right direction.

The first heat exchanger 730 may be provided in a shape lying inside the heat exchanger case 710. The width of the first heat exchanger 730 in the front-and-rear direction may be greater than the height in the vertical direction.

The front end portion of the first heat exchanger 730 may define the inlet side through which the fluid is introduced into the first heat exchanger 730, and the rear end portion of the first heat exchanger 730 may define the discharge side through which the fluid passing through the first heat exchanger 730 is discharged.

The first heat exchanger 730 may extend obliquely upward toward the rear side.

The drain hole 718 may be located adjacent to the front end of the first heat exchanger 730, and may be formed in a bottom of the front end portion of the first heat exchanger 730.

The heat exchanger case 710 defines a case inlet portion 715 through which the fluid in the first storage space 15 is introduced toward the first heat exchanger 730.

The case inlet portion 715 may be defined by being recessed from the surface of the heat exchanger case 710. For example, the case inlet portion 715 may be recessed from the upper surface of the first heat exchanger case 710.

The heat exchanger case 710 may define an inner passage 716 through which the fluid flows. The inner passage 716 may be configured to be recessed downward from the case inlet portion 715 and bent toward the accommodation space 705.

The inner passage 716 may be connected to the inner surface of the heat exchanger case 710 and may communicate with the accommodation space 705.

A case outlet portion 717 communicating with the inner passage 716 may be defined on the inner surface of the heat exchanger case 710. That is, one end portion of the inner passage 716 may define the case inlet portion 715, and the other end portion of the inner passage 716 may define the case outlet portion 717.

The case inlet portion 715 may communicate with the inlet portion 51. In detail, the upper surface of the heat exchanger case 710 may be in contact with the bottom surface of the partition wall 50, and the inlet portion 51 and the case inlet portion 715 may be disposed in the vertical direction.

The heat exchanger case 710 may further include a case wall 713 separating the accommodation space 705 and the inner passage 716. The case wall 713 may be in contact with the bottom surface of the partition wall 50.

The fluid in the first storage space 15 may pass through the inlet portion 51, flow into the inner passage 716 through the case inlet portion 715, and then flow into the accommodation space 705 through the case outlet portion 717.

The second passage may include a first through hole in contact with the second storage space 16, a second through hole in contact with the first passage, and a portion connecting the first and second through holes.

The first through hole may provide a path through which the fluid in the inner space of the second storage space 16 flows to the inner space of the second passage. The second through hole may provide a path through which the fluid in the inner space of the second passage flows to the first passage.

In the partition wall 50, an outlet portion 58 through which the fluid in the inner space of the second storage space 16 is discharged may be defined.

For example, in the outlet portion 58, a part of the partition wall 50 may penetrate vertically to define a fluid passage.

The fluid heat-exchanged in the first heat exchanger 730 may be discharged to the duct 30 through the outlet portion 58.

For example, the outlet portion 58 may be defined above the first heat exchanger 730.

A first end portion 58*a* of the outlet portion 58 may define a first through hole configured to provide a passage through which the fluid in the inner space of the second storage space 16 flows to the inner space of the second passage. For example, the first end portion 58*a* may define a lower end portion of the outlet portion 58.

A second end portion 58*b* of the outlet portion 58 may define a first through hole configured to provide a passage through which the fluid in the inner space of the second passage flows to the first passage. For example, the second end portion 58*b* may define an upper end portion of the outlet portion 58.

The first through hole may be spaced apart from the second through hole in the X-axis direction. For example, a line (l5) passing through the center of the first end portion 58*a* of the outlet portion 58 may be spaced apart from a line (l6) passing through the center of the second end portion 58*b* of the outlet portion 58 in the X-axis direction.

The first through hole may be provided to be more adjacent to the door 20 than the second through hole. For example, the first end portion 58*a* of the outlet portion 58 may be provided to be closer to the duct 30 than the second end portion 58*b* of the outlet portion 58.

The second through hole may be provided to be closer to the first passage than the first through hole. For example, the first end portion 58*a* of the outlet portion 58 may be provided to be closer to the duct 30 than the second end portion 58*b* of the outlet portion 58.

The second through hole may be provided to be aligned with the suction hole of the first passage. For example, the second end portion 58*b* of the outlet portion 58 may be provided to be aligned with the duct inlet portion 33 of the duct 30.

The first through hole may be spaced apart from the second through hole in the vertical direction (Y-axis direction) perpendicular to the horizontal direction (X-axis direction). For example, the first end portion 58*a* of the outlet portion 58 may be spaced apart from the second end portion 58*b* of the outlet portion 58 in the Y-axis direction.

The first through hole may be disposed in a state of being spaced apart from the second through hole in the X-axis direction perpendicular to the Y-axis direction. For example, the center of the first end portion 58*a* of the outlet portion 58 may be spaced apart from the center of the second end portion 58*b* of the outlet portion 58 in the X-axis direction.

The direction in which the fluid flows in the second passage may include a first portion in which the fluid flows in the Y-axis direction and a second portion in which the fluid flows in the X-axis direction. The direction in which the fluid flows in the second passage may include a portion in which the fluid flows in an inclined direction that is an angle between the Y-axis direction and the X-axis direction.

The direction in which the fluid flows inside the outlet portion 58 includes a first portion in which the fluid discharged from the second storage space 16 flows upward (Y-axis direction) and a second portion in which the fluid flows backward (X-axis direction).

The outlet portion 58 may include an inner circumferential surface that guides the fluid to flow from the first end portion 58*a* toward the second end portion 58*b* in an inclined direction that is an angle between the Y-axis direction and the X-axis direction.

The inner circumferential surface of the outlet portion 58 may include a guide surface extending obliquely or roundly in a direction toward an angle between the Y-axis direction and the X-axis direction.

In one example, the inner circumferential surface of the outlet portion 58 may include a guide surface rearward inclined or rounded so that the fluid flowing upward through the first heat exchange 730 can be redirected to the rear toward the duct 30.

The second passage may be provided inside or near the wall partitioning the first storage space 15 and the second storage space 16.

After the second passage is disposed inside the second wall, the inside of the second wall may be filled with an insulating material.

For example, the outlet portion 58 may pass through the partition wall 50, and the periphery of the outlet portion 58 may be filled with an insulating material.

A fan assembly 750 may be provided downstream of the first heat exchanger 730. The fan assembly 750 may be disposed outside the heat exchanger case 710.

For example, the fan assembly 750 may be provided above the partition wall 50.

The fan assembly 750 may be provided in the duct 30. The duct 30 may be provided on the rear wall of the first storage space 15 and may extend in the vertical direction. The inner space of the duct 30 may communicate with the outlet portion 58. A duct discharge hole 35 through which the fluid is discharged to the first storage space 15 may be defined in the duct 30.

For example, the fan assembly 750 may be disposed adjacent to the duct inlet portion 33.

For example, the fan assembly 750 may be provided at the lower end portion of the duct 30.

The fan assembly 750 may include a first fan 751 configured as a centrifugal fan.

The first fan 751 may be disposed to be erected in the horizontal direction. In other words, the axial direction of the first fan 751 may be configured to face the front-and-rear direction.

The central axis of the cooling fan 751 may be formed to pass through the first storage space 15 in the front-and-rear direction.

The fan assembly 750 may include a shroud 753 on which the first fan 751 is installed. The first fan 751 may be located inside the shroud 753.

The shroud 753 may be coupled to the duct 30. The fluid discharged from the outlet portion 58 may be introduced into the duct 30, be bent forward, and be sucked in the axial direction of the first fan 751.

The flow of the fluid circulating in the storage space 15 and the heat exchange device 100*b* according to the driving of the first fan 751 will be briefly described.

When the first fan 751 is driven, the fluid in the first storage space 15 flows into the case inlet portion 715 of the heat exchanger case 710 through the inlet portion 51 of the partition wall 50, and flows into the first heat exchanger 730 through the inner passage 716 and the case outlet portion 717. In the process of passing through the first heat exchanger 730, the fluid may flow from the front portion to the rear portion of the first heat exchanger 730.

The fluid passing through the first heat exchanger 730 is discharged from the heat exchanger case 710 and is introduced into the duct 30 through the outlet portion 58 of the partition wall 50. The fluid may be introduced in the axial direction of the first fan 751 and discharged in the radial direction, and may flow upward along the duct 30. The fluid in the duct 30 may be supplied to the first storage space 15 through the duct discharge hole 35.

INDUSTRIAL APPLICABILITY

According to an embodiment of the present disclosure, first and second storage spaces are fluidly connected to each other. Therefore, the fluid heat-exchanged in a first heat exchanger may be easily supplied to the first storage space, and the fluid in the first storage space may be easily returned to the second storage space. Therefore, the industrial applicability is remarkable.

The invention claimed is:

1. A storehouse comprising:

a first space configured to provide a space in which goods are stored;

a second space configured to provide a space in which a first heat exchanger is accommodated, the second space being fluidly connected to the first space;

a third space configured to provide a space in which a second heat exchanger is accommodated;

a first wall defining at least a part of the first space;

a second wall defining at least a part of the second space;

a third wall defining at least a part of the third space;

a first passage provided at at least one of an inside of the first wall or in a vicinity of the first wall and through which a fluid flows, the first passage including a discharge duct provided at the first wall;

a second passage provided at at least one of an inside of the second wall or in a vicinity of the second wall, and through which the fluid flows; and a shroud in which a fan is accommodated and disposed in the second passage, wherein the second wall includes a partition that separates the first space from the second space, wherein the second passage includes a first through hole formed at the partition, and wherein the storehouse further comprises a connector including:

a first duct including a first part coupled to the shroud and a second part disposed in the partition;

a second duct disposed in the first space and including a part coupled to the discharge duct; and a flange disposed between the second part of the first duct and the second duct and including a portion supported by the partition.

2. The storehouse of claim 1, wherein the first part of the first duct protrudes from the partition and is coupled to the shroud that is disposed adjacent to the partition.

3. The storehouse of claim 1, wherein the second passage further includes a second through hole opening toward the second space, the first through hole opening toward the first passage, and a passage section connecting the first and second through holes, and wherein the shroud is disposed in the passage section.

4. The storehouse of claim 3, wherein the second through hole is configured to provide a path through which the fluid in an inner space of the first space flows to an inner space of the second passage.

5. The storehouse of claim 3, wherein the first through hole is configured to provide a path through which the fluid in an inner space of the second passage flows to the first passage.

6. The storehouse of claim 3, wherein the storehouse further comprises a door to open and close the first space, and the second through hole is provided to be closer to the door than the first through hole.

7. The storehouse of claim 3, wherein the first through hole is provided to be closer to the first passage than the second through hole and is aligned with a suction hole of the discharge duct.

8. The storehouse of claim 3, wherein the passage section of the second passage includes a first portion in which the fluid flows in a vertical direction and a second portion in which the fluid flows in a horizontal direction.

9. The storehouse of claim 3, wherein the passage section of the second passage includes a portion in which the fluid flows in an inclined direction that is at an angle between a vertical direction and a horizontal direction.

10. The storehouse of claim 1, wherein the second duct of the connector includes an inlet to communicate with the first through hole of the partition, an outlet to communicate with the discharge duct, and a guide wall to connect to the inlet and the outlet and having a round part with a curvature.

11. The storehouse of claim 10, wherein the second wall includes a heat exchanger case in which the first heat exchanger is disposed, and wherein the fan is disposed inside the heat exchanger case, the fan being overlapped with the round part of the connector in a vertical direction.

12. A storehouse comprising:

a first space configured to provide a space in which goods are stored;

a second space configured to provide a space in which a first heat exchanger is accommodated, the second space being fluidly connected to the first space;

a first wall defining at least a part of the first space;

a second wall defining at least a part of the second space;

a first passage provided at at least one of an inside of the first wall or in a vicinity of the first wall and through which a fluid flows;

a second passage provided at at least one of an inside of the second wall or in a vicinity of the second wall, and through which the fluid flows; and a fan configured to generate airflow passing through at least one of the first passage or the second passage, wherein the second wall includes a partition that separates the first space from the second space, wherein the second passage includes a through hole formed at the partition, wherein at least a portion of the fan is disposed in the through hole, and wherein the first space and the second space are arranged in a vertical direction, and the fan includes an axial fan such that an axis of the fan extends in the vertical direction.

13. The storehouse of claim 12, wherein the second passage further includes an additional through hole opening toward the second space, and wherein the through hole opens toward the first passage.

14. The storehouse of claim 13, wherein the storehouse further includes a door to open and close the first space, and the additional through hole is provided to be closer to the door than the through hole.

15. The storehouse of claim 13, wherein the through hole is provided to be closer to the first passage than the additional through hole.

16. The storehouse of claim 12,
wherein the second wall includes a drain hole, and
wherein the axis of the fan passes through the drain hole.

* * * * *